US009638427B2

(12) United States Patent
Reese et al.

(10) Patent No.: US 9,638,427 B2
(45) Date of Patent: May 2, 2017

(54) APPARATUS AND METHOD FOR BLOCKING FLAME AND SPREADING HEATED GAS FROM A BROILER FLUE

(75) Inventors: Robert J. Reese, Edwardsville, IL (US); Gregory K. Swanson, Eureka, MO (US); Daryl R. Monroe, Granite City, IL (US); Douglas M. Lewis, St. Charles, MO (US)

(73) Assignee: BURGER KING CORPORATION, Miami, FL (US)

( * ) Notice: Subject to any disclaimer, the term of this patent is extended or adjusted under 35 U.S.C. 154(b) by 1131 days.

(21) Appl. No.: 13/051,607

(22) Filed: Mar. 18, 2011

(65) Prior Publication Data

US 2011/0226230 A1 Sep. 22, 2011

Related U.S. Application Data

(60) Provisional application No. 61/315,471, filed on Mar. 19, 2010.

(51) Int. Cl.
*F24C 15/00* (2006.01)
*F24C 15/20* (2006.01)
*F24C 15/32* (2006.01)

(52) U.S. Cl.
CPC ..... *F24C 15/20* (2013.01); *F24C 15/205* (2013.01); *F24C 15/32* (2013.01)

(58) Field of Classification Search
CPC ..... F24C 15/32; F24C 15/20
USPC ..... 126/45 R, 39 K, 83, 312; 99/447
See application file for complete search history.

(56) References Cited

U.S. PATENT DOCUMENTS

| | | | |
|---|---|---|---|
| 747,928 | A | 12/1903 | Rechtold et al. |
| 3,130,961 | A | 4/1964 | Verner et al. |
| 3,248,858 | A | 5/1966 | Toke |
| 3,433,146 | A | 3/1969 | Russell |
| 3,667,371 | A | 6/1972 | Russell |
| 3,721,178 | A | 3/1973 | Szabrak et al. |
| 3,785,778 | A | 1/1974 | Burstein et al. |
| 3,955,949 | A | 5/1976 | Rohrer |
| 4,043,320 | A | 8/1977 | Strew |
| 4,050,446 | A | 9/1977 | Giuffre |
| 4,054,418 | A | 10/1977 | Miller et al. |
| 4,098,567 | A | 7/1978 | Hubbert |
| 4,113,439 | A | 9/1978 | Ookubo et al. |
| 4,138,220 | A | 2/1979 | Davies et al. |
| 4,213,947 | A | 7/1980 | Fremont et al. |
| 4,363,785 | A | 12/1982 | Willson |
| 4,458,662 | A | 7/1984 | Barnett |
| 4,462,307 | A | 7/1984 | Wells |
| 4,479,921 | A | 10/1984 | Allaire et al. |
| 4,505,194 | A | 3/1985 | Bishop et al. |

(Continued)

*Primary Examiner* — Avinash Savani
*Assistant Examiner* — Aaron Heyamoto
(74) *Attorney, Agent, or Firm* — Arent Fox LLP

(57) ABSTRACT

Apparatus for substantially blocking flames and spreading heated gases emitted from a broiler flue. The apparatus includes a riser placed above the broiler flue for defining a pathway along which heated gases are exhausted from the flue, a catalyst support on the riser for supporting a catalyst in the pathway for flow of heated gases through the catalyst from a bottom surface of the catalyst to a top surface of the catalyst, and a plurality of baffles in the riser extending across the pathway below the catalyst support. The baffles have the shape of inverted troughs.

18 Claims, 23 Drawing Sheets

(56) References Cited

U.S. PATENT DOCUMENTS

| | | | | |
|---|---|---|---|---|
| 4,580,546 | A | 4/1986 | Barnett | |
| 4,582,044 | A | 4/1986 | Ferguson et al. | |
| 4,584,177 | A | 4/1986 | Fernbach et al. | |
| 4,646,712 | A | 3/1987 | Ferguson et al. | |
| 4,690,701 | A | 9/1987 | Hedrick et al. | |
| 4,827,852 | A | 5/1989 | Piontkowski | |
| 4,854,949 | A | 8/1989 | Giles, Sr. et al. | |
| 4,856,491 | A | 8/1989 | Ferguson et al. | |
| 4,930,489 | A | 6/1990 | McFadden | |
| 4,944,782 | A | 7/1990 | Rajendran et al. | |
| 4,951,648 | A | 8/1990 | Shukla et al. | |
| 4,984,559 | A | 1/1991 | Bennet | |
| 5,357,941 | A | 10/1994 | Hans Duerichen et al. | |
| 5,368,009 | A * | 11/1994 | Jones | 126/41 R |
| 5,431,887 | A | 7/1995 | Bar-Ilan | |
| 5,492,055 | A | 2/1996 | Nevin et al. | |
| 5,556,819 | A | 9/1996 | Bar-Ilan | |
| 5,580,535 | A | 12/1996 | Hoke et al. | |
| 5,622,100 | A | 4/1997 | King et al. | |
| 5,693,298 | A | 12/1997 | Bar-Ilan | |
| 5,727,451 | A | 3/1998 | DeMars | |
| 5,782,230 | A | 7/1998 | Linnebur et al. | |
| 5,806,412 | A | 9/1998 | Bedford et al. | |
| 6,125,838 | A | 10/2000 | Hedgpeth | |
| 6,131,559 | A | 10/2000 | Norris et al. | |
| 6,817,283 | B2 | 11/2004 | Jones et al. | |
| 6,913,458 | B2 | 7/2005 | Mosher, II et al. | |
| 7,004,159 | B1 | 2/2006 | Carpenter et al. | |
| 7,041,159 | B2 * | 5/2006 | Entezarian | B01D 50/002 55/320 |
| 7,370,647 | B2 | 5/2008 | Thorneywork | |
| 7,552,587 | B2 | 6/2009 | Galligan | |
| 7,862,787 | B1 * | 1/2011 | Skelley et al. | 423/210 |
| 2004/0037753 | A1 | 2/2004 | Quinn et al. | |
| 2005/0232838 | A1 | 10/2005 | Cichanowicz | |
| 2005/0284461 | A1 | 12/2005 | Hsu | |
| 2006/0171866 | A1 | 8/2006 | Galligan | |
| 2007/0221199 | A1 | 9/2007 | Hake et al. | |
| 2010/0322835 | A1 | 12/2010 | Skelley et al. | |
| 2011/0018190 | A1 * | 1/2011 | Mandel et al. | 271/109 |

* cited by examiner

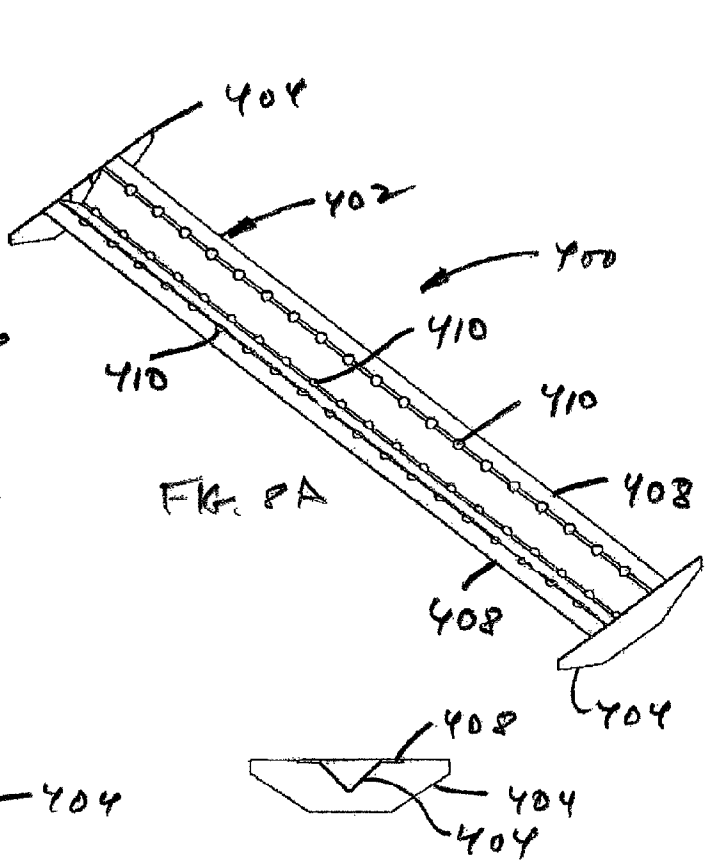
FIG. 8A
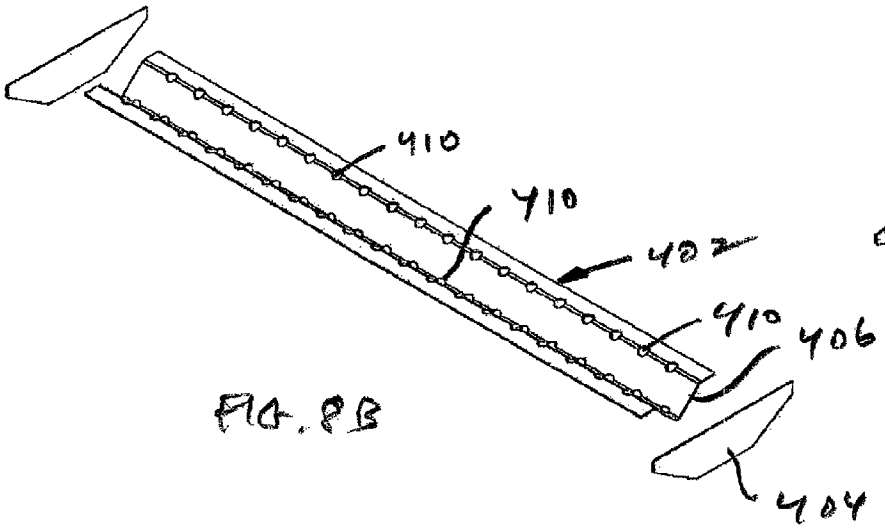
FIG. 8B
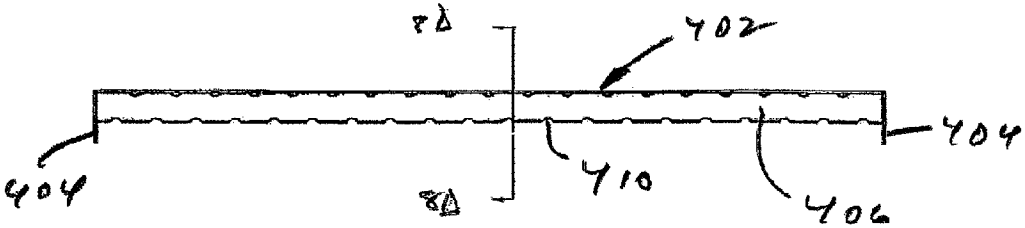
FIG. 8C
FIG. 8D

APPARATUS AND METHOD FOR BLOCKING FLAME AND SPREADING HEATED GAS FROM A BROILER FLUE

CROSS-REFERENCE TO RELATED APPLICATION

This application is a non-provisional patent application and claims priority from U.S. Provisional Patent Application Ser. No. 61/315,471, filed Mar. 19, 2010, which is incorporated herein by reference.

FIELD OF THE INVENTION

The present invention generally relates to cooking equipment, and more particularly to cooking equipment which uses a catalyst to clean exhaust gases from the equipment.

BACKGROUND OF THE INVENTION

Cooking equipment such as broilers emit high temperature flames and gases laden with grease, smoke, and other particles during the cooking process. Catalysts are often used to clean the gases. However, conditions such as high cooking rates, grease/combustible residue from product cooking, and inadequate broiler cleaning, can contribute to shortened catalyst life by allowing flame impingement on the catalyst and/or uneven heating of the catalyst that may result in exceeding the material rating of the catalyst components. When flame-impingement and/or uneven heating continues over time, erosion of the catalyst wash coat, precious metals (catalytic metals that oxidize grease and other particulate matter) can lead to sections of the catalyst being consumed, resulting in degraded performance.

SUMMARY OF THE INVENTION

The present invention is directed to apparatus for substantially blocking flames and spreading heated gases from a broiler flue. In one embodiment, the apparatus comprises a riser adapted to be placed above the broiler flue for defining a pathway along which heated gases are exhausted from the flue, a catalyst support on the riser for supporting a catalyst in the pathway for flow of heated gases through the catalyst, and a plurality of baffles in the riser extending across the pathway below the catalyst support. The baffles have the shape of inverted troughs for substantially blocking flames emitted from the broiler flue and for spreading heated gases exhausted from the flue for more uniform distribution of the heated gases across a bottom surface of the catalyst. Each baffle is spaced from an adjacent baffle by a horizontal distance D1 in the range of 0.25-1.0 in. to provide a horizontal gap sufficiently small to substantially block flames but sufficiently large to allow flow of heated gases to the catalyst without an excessive pressure drop.

In another embodiment, the apparatus comprises a riser adapted to be placed above the broiler flue for defining a pathway along which heated gases are exhausted from the flue, a catalyst support on the riser for supporting a catalyst in the pathway for flow of heated gases through the catalyst, and a plurality of baffles in the riser extending across the pathway below the catalyst support. The baffles have the shape of inverted troughs for substantially blocking flames emitted from the broiler flue and for spreading heated gases exhausted from the flue for more uniform distribution of the heated gases across a bottom surface of the catalyst. The baffles comprise a first baffle having left and right downwardly diverging legs and a second baffle adjacent the first baffle having left and right downwardly diverging legs. The right leg of a first baffle is spaced from the left leg of the second adjacent baffle by a minimum angled distance in the range of 0.75-2.2 in. taken along a line projected from the diverging right leg of the first baffle to the diverging left leg of second baffle. This angled distance defines an angled gap through which heated gases flow at an angle toward the catalyst for a more uniform distribution of the heated gases over the bottom of the catalyst.

In another embodiment, the apparatus comprises a riser adapted to be placed above the broiler flue for defining a pathway along which heated gases are exhausted from the flue, a catalyst support on the riser for supporting a catalyst in the pathway for flow of heated gases through the catalyst, and a plurality of baffles in the riser extending across the pathway below the catalyst support. The baffles have the shape of inverted troughs for substantially blocking flames emitted from the broiler flue and for spreading heated gases exhausted from the flue for more uniform distribution of the heated gases across a bottom surface of the catalyst. Each baffle is spaced from an adjacent baffle by a horizontal distance D1 in the range of 0.25-1.0 in. to provide a horizontal gap sufficiently small to substantially block flames but sufficiently large to allow flow of heated gases to the catalyst without an excessive pressure drop. Each baffle has left and right downwardly diverging legs, the right leg of the first baffle being spaced from the left leg of the second baffle by a minimum angled distance D2 in the range of 0.75-2.2 in. taken along a line projected from the diverging right leg of the first baffle to the diverging left leg of second baffle. The right leg of the second baffle is spaced from the left leg of the third baffle by a minimum angled distance D3 in the range of 0.75-2.2 in. taken along a line projected from the diverging right leg of the second baffle to the diverging left leg of third baffle. The angled distances D2 and D3 define angled gaps through which heated gases flow at an angle toward the catalyst for a more uniform distribution of the heated gases over the bottom of the catalyst.

This invention is also directed to a method of mounting apparatus on a broiler for substantially blocking flames and spreading heated gases from a flue of the broiler. The apparatus comprises a riser adapted to be placed above the broiler flue for defining a pathway along which heated gases are exhausted from the flue, a catalyst support on the riser for supporting a catalyst in the pathway for flow of heated gases through the catalyst, and a plurality of baffles in the riser extending across the pathway below the catalyst support. The baffles have the shape of inverted troughs for substantially blocking flames emitted from the broiler flue and for spreading heated gases exhausted from the flue for more uniform distribution of the heated gases across a bottom surface of the catalyst. Each of the baffles is spaced from an adjacent baffle by a horizontal distance D1 in the range of 0.25-1.0 in. to provide a horizontal gap sufficiently small to substantially block flames but sufficiently large to allow flow of heated gases to the catalyst without excessive pressure drop. The method comprises mounting the riser on the broiler flue such that the baffles are at least six in. above a cooking surface in the broiler.

Other objects and features will be in part apparent and in part pointed out hereinafter.

BRIEF DESCRIPTION OF THE DRAWINGS

FIG. 8A is a perspective view of an alternative baffle design;

FIG. 8B is an exploded view showing various components of the baffle design of FIG. 8A;

FIG. 8C is a side elevation of FIG. 8A;

FIG. 8D is a vertical section taken in the plane of lines 8D-8D of FIG. 8C;

FIG. 10D is a vertical section taken in the plane of lines 10D-8D of FIG. 10C;

Corresponding reference characters indicate corresponding parts throughout the drawings.

DETAILED DESCRIPTION

Figure 1:
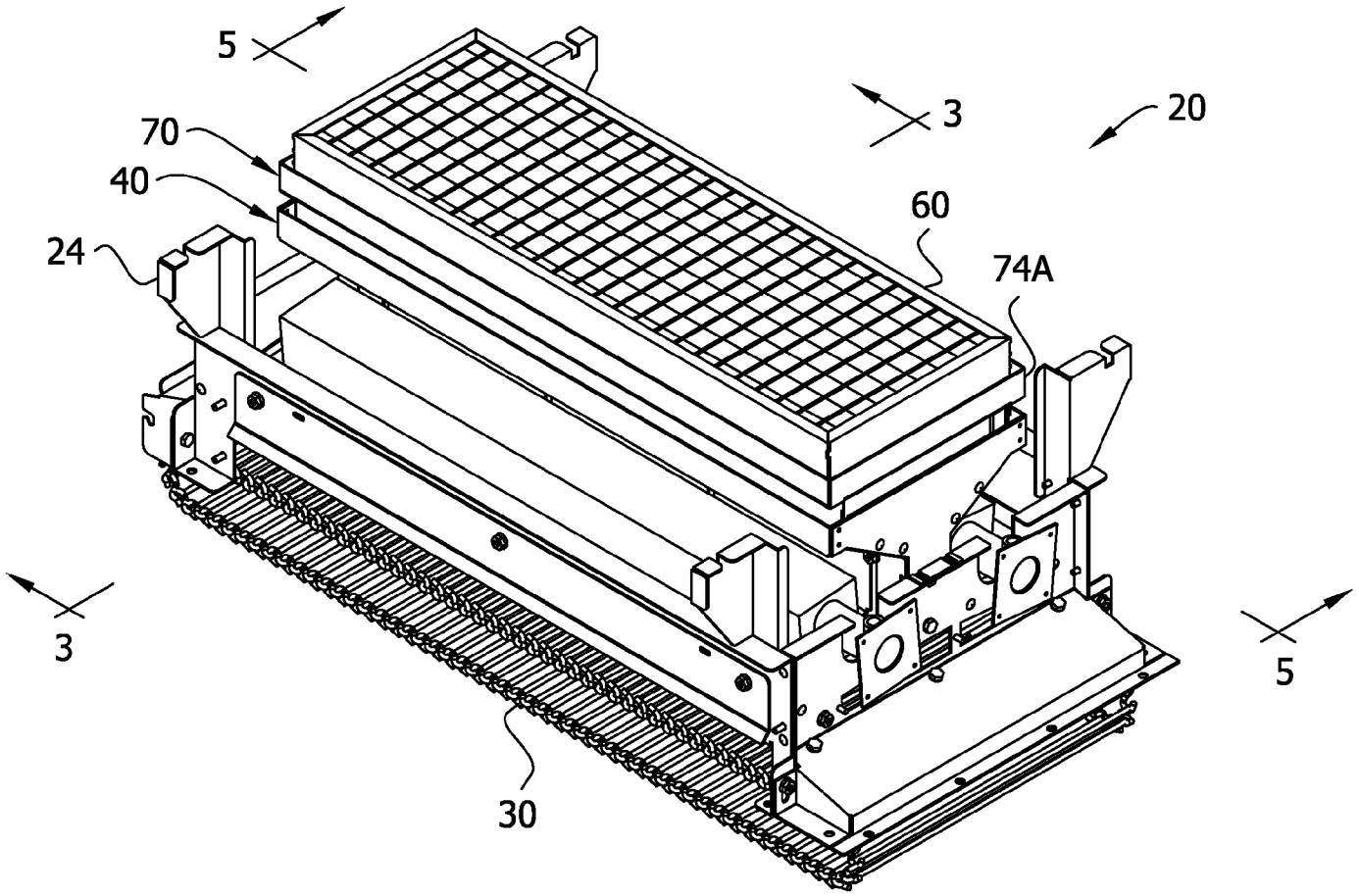
FIG. 1 is a top perspective of a broiler having a heat and flame spreader of this invention, parts of the broiler being removed to show details.
Figure 2:
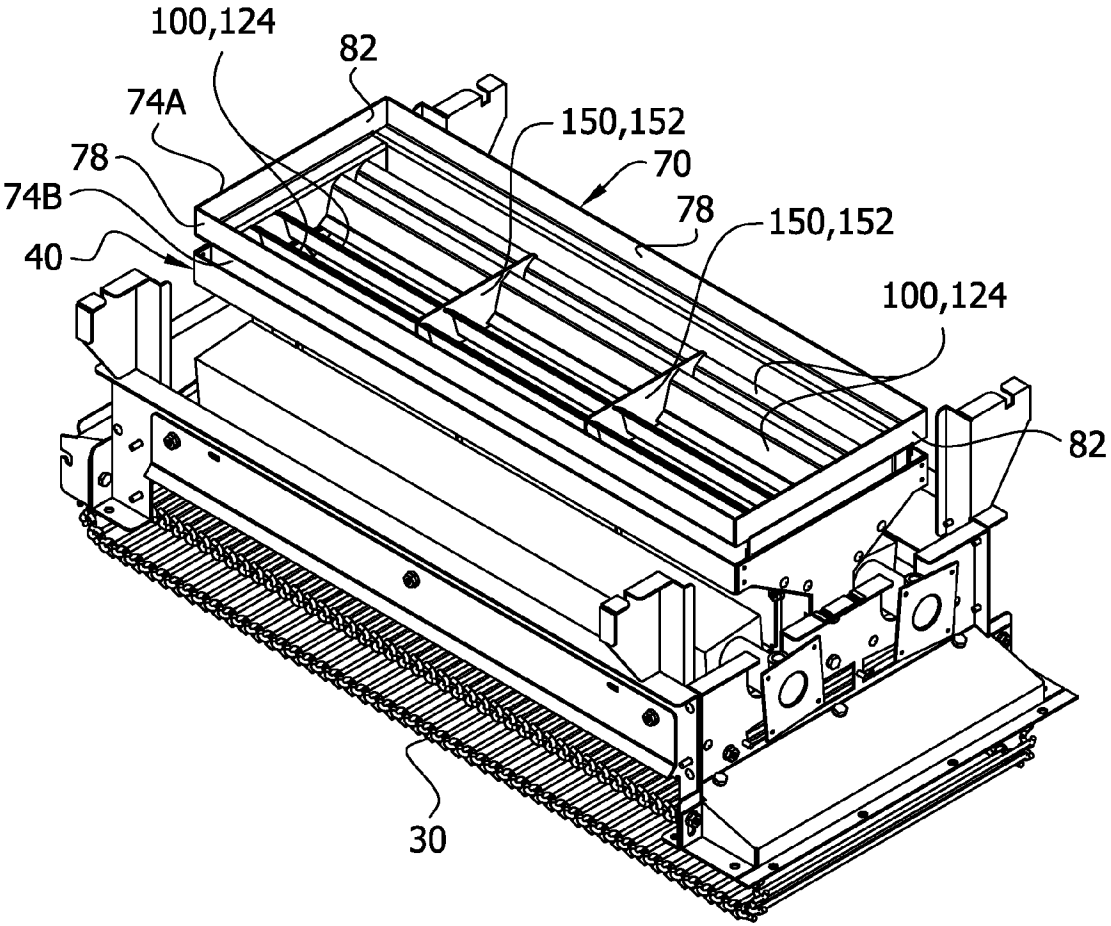
FIG. 2 is a view similar to FIG. 1 but with a catalyst removed to show details of the heat and flame spreader.

Referring now to the drawings, FIGS. 1-5 show a broiler, generally designated 20, comprising a housing 24 defining a cooking chamber 26, a conveyor 30 defining a cooking surface for moving food products (e.g., hamburgers) through the cooking chamber, and a burner system 34 for cooking food products on cooking surface of the conveyor. The burner system 34 is a gas system which emits infrared energy and flames to cook the food. Although not shown, the burner system can also include burners both above and below the food. Hot gas and by-products of the cooking process (e.g., grease, smoke, and other particles) escape the cooking chamber 26 through a flue 40 on the housing. Flames generated during the cooking process, as during grease flare-ups, may also be emitted up through the flue assembly 40. The burner system 34 may also be an electric system or a combination gas/electric system.

Figure 3:
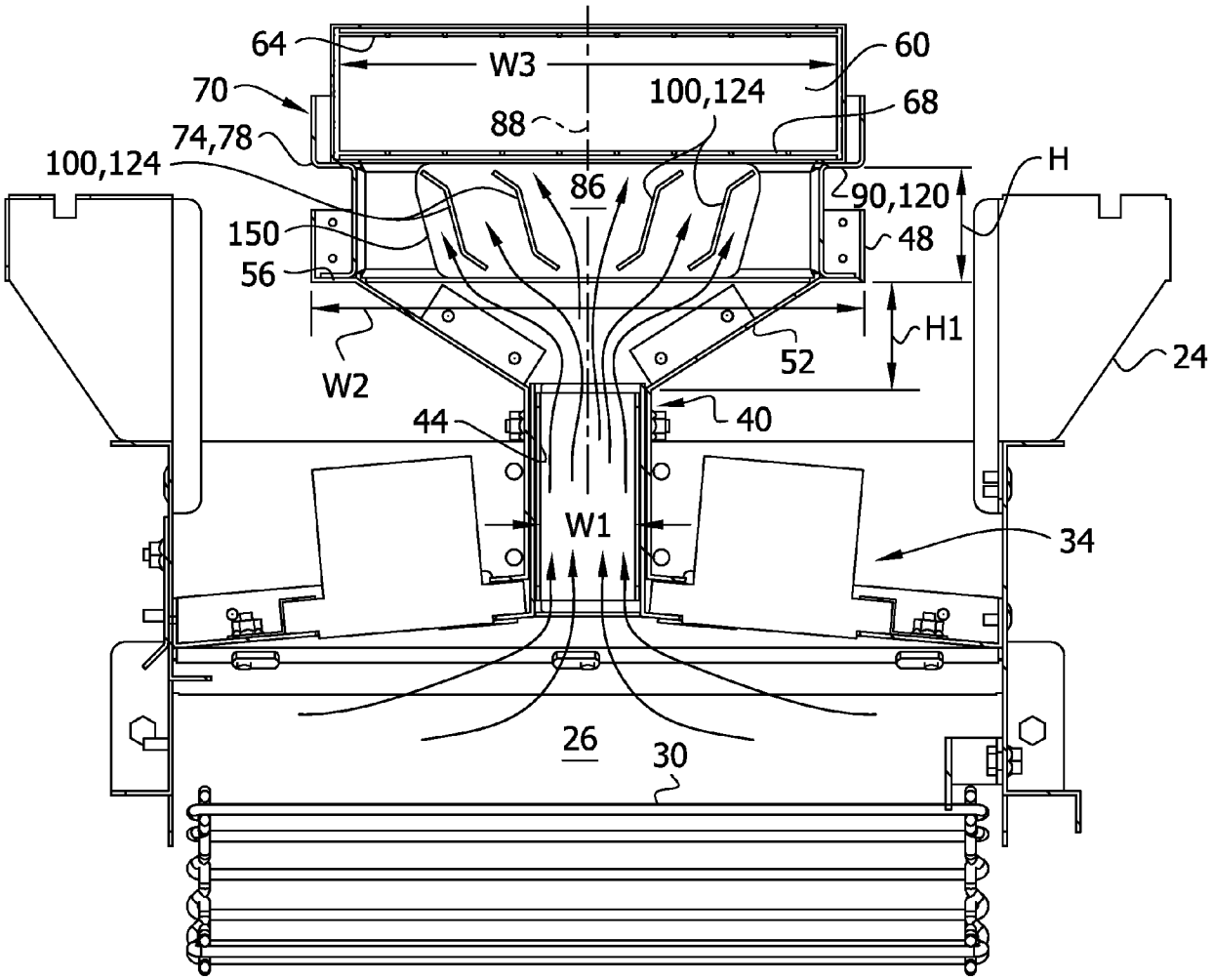
FIG. 3 is an enlarged vertical section taken in the plane of line 3-3 of FIG. 1.
Figure 5:
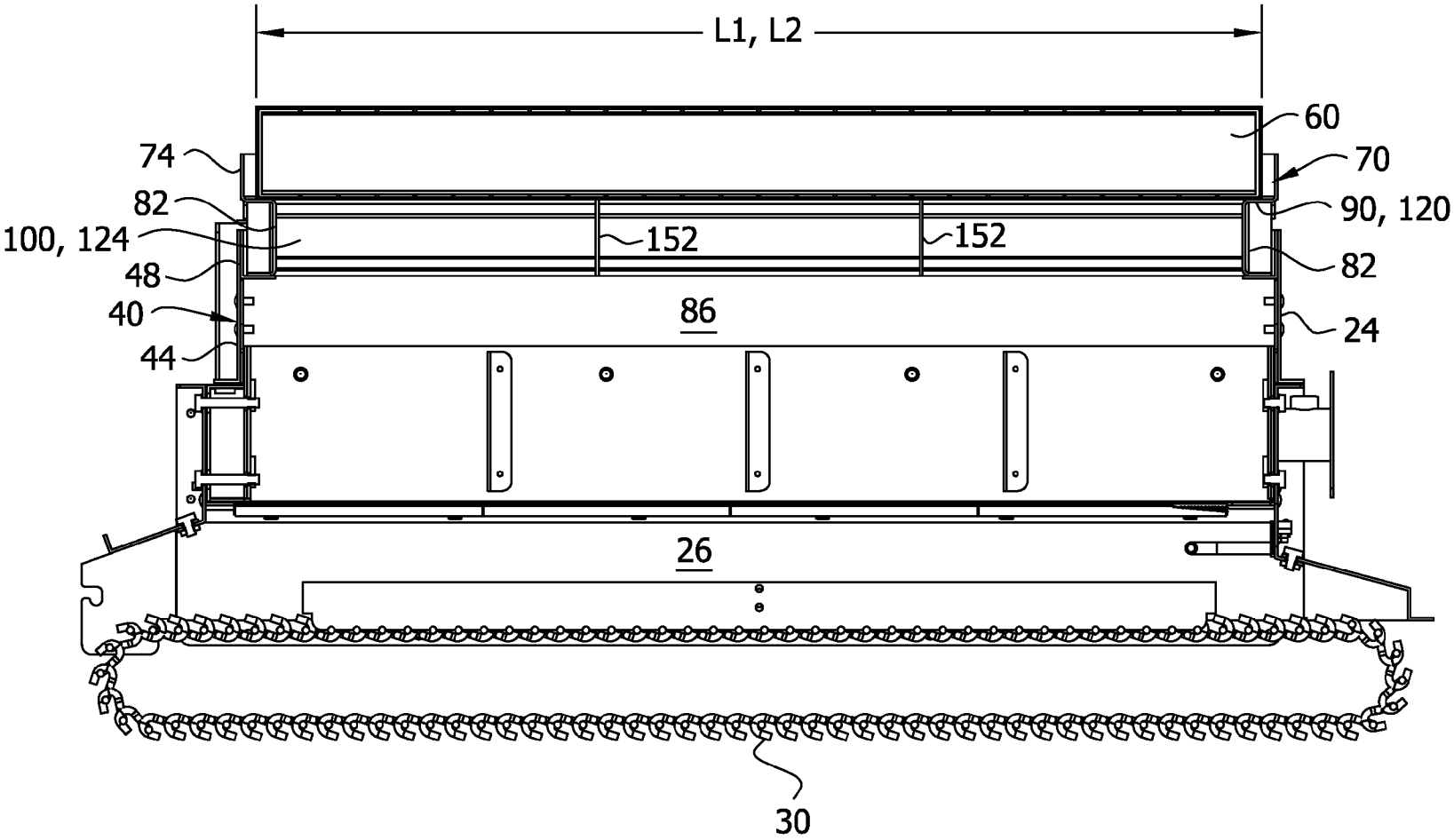
FIG. 5 is an enlarged vertical section taken in the plane of line 5-5 of FIG. 1.

The flue 40 includes a rectangular lower flue stack 44 communicating at its lower end with the cooking chamber 26, and a rectangular upper flue stack 48 having a floor 52 sloping up from the lower flue stack to a rectangular shoulder 56 at the upper end of the flue assembly. The lower flue stack 44 is relatively narrow, having a length L1 and a width W1 (FIGS. 3 and 5). The upper flue stack 48 has a length L2 about the same as L1, and a width W2 at the shoulder substantially less than W1. The vertical distance H1 between the top of the lower flue stack and the shoulder 56 is about 2.5 in. (FIG. 3). The shape of the flue 40 and its component parts may be other than rectangular (e.g., circular). The distance H1 may also vary.

A catalyst 60 is provided for cleaning the heated gas escaping through the flue 40. The catalyst 60 has a top surface 64, a bottom surface 68, and is constructed to withstand high temperature heat (e.g., up to about 2000 degrees F.). The catalyst contains reactive metals which oxidize particles in the gases passing through the catalyst from its bottom surface to its top surface, as will be understood by those skilled in the art. The catalyst 60 is mounted above the flue assembly 40. It is generally rectangular in shape (matching that of the flue 40), having a length L3 and a width W3. The width W3 of the catalyst is substantially greater than the width W1 of the lower flue stack. The catalyst 60 is mounted in a horizontal plane directly above the flue and is generally centered with respect to the flue. The catalyst may also be mounted at an angle off horizontal (e.g., 0-75 degrees).

Figure 4:
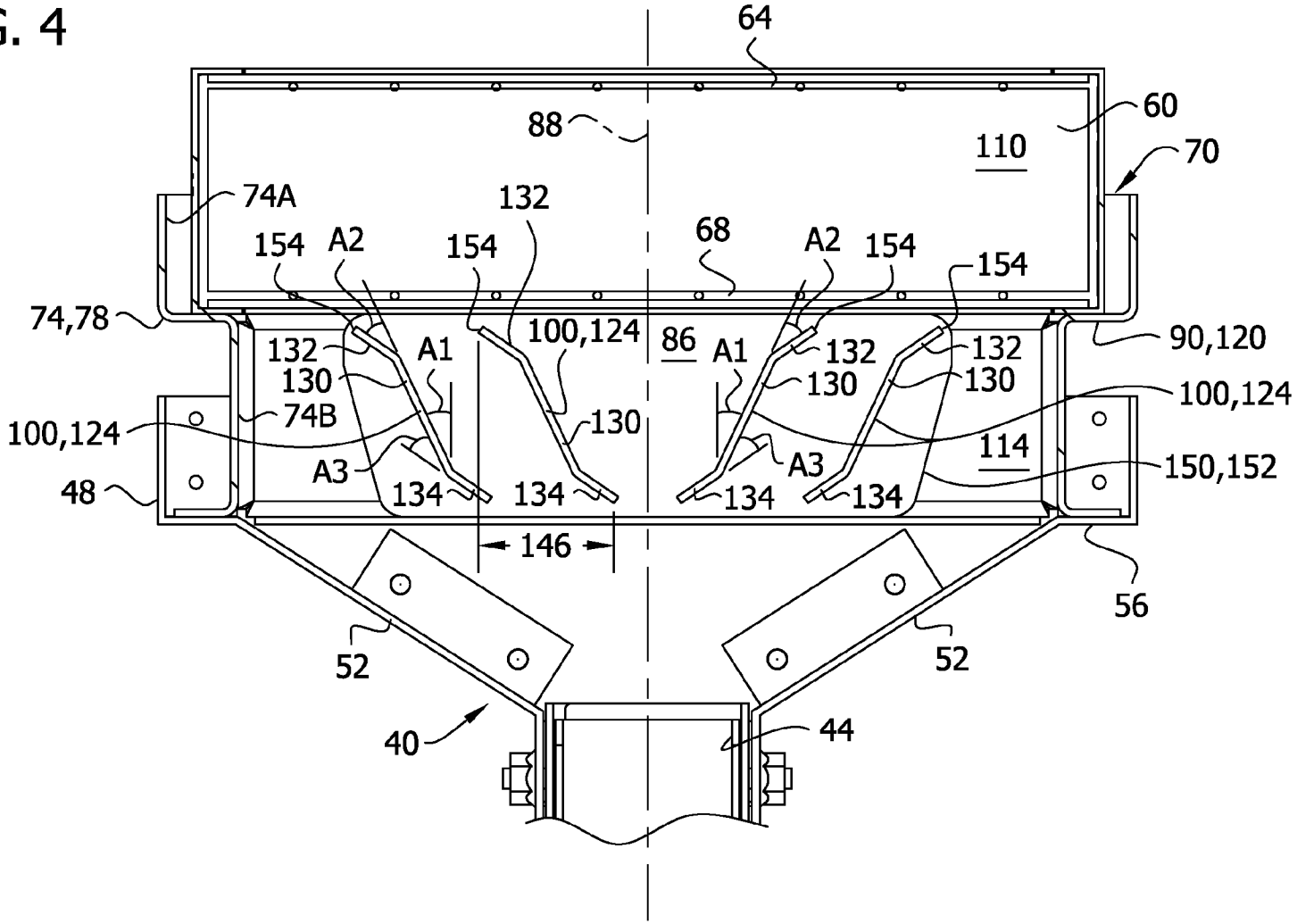
FIG. 4 is an enlarged portion of FIG. 3 showing a flue assembly of the broiler, the heat and flame spreader positioned above the flue assembly, and the catalyst supported by the heat and flame spreader.

Referring to FIG. 4, the catalyst 60 is mounted in a heat and flame spreader, generally designated 70. The spreader comprises a rectangular riser 74 having a first pair of opposing side walls 78 extending lengthwise of the flue 40 and a second pair of opposing side walls 82 extending widthwise of the flue (see FIG. 2). The riser 74 is adapted to be positioned on the rectangular shoulder 56 of the upper flue stack 48, as illustrated best in FIGS. 3-5. The riser 74 defines a pathway 86 for heated gases exhausted from the flue 40. The pathway has a generally vertical axis 88. A catalyst support 90 is provided on the riser 74 for supporting the catalyst 60 in the pathway 86 for flow of heated gases through the catalyst from the bottom surface 68 of the catalyst to the top surface 64 of the catalyst. A number of deflectors or baffles 100 are mounted in the pathway 86 below the catalyst support 90 for deflecting flames and heated gases exhausted up through the flue 40 such that the flames and heated gases are spread more uniformly across the bottom surface 68 of the catalyst. The catalyst 60 and riser 74 may have shapes other than rectangular.

The riser 74 has an annular upper portion 74A defining an upper volume 110 for receiving the catalyst 60 and an annular lower portion 74B defining a lower volume 114 containing the baffles 100 (FIG. 4). The upper portion 74A is wider than the lower portion 74B. The catalyst 60 rests on the catalyst support 90 which, in this embodiment, comprises an annular member 120 connecting the upper and lower annular portions 74A, 74B of the riser. The catalyst 60 may be supported in other ways above the baffles 100. The annular lower portion 74B has a height H in the range of 1.0-8.0 in., and desirably about 4.0 in.

In the illustrated embodiment, the baffles 100 comprise a number of elongate, spaced-apart baffle plates 124 extending generally horizontally across the pathway 86 between the opposing side walls 82 of the lower portion 74B of the riser. The baffle plates 124 are suitably attached to the riser 74, as by welding or by fasteners or tabs. Alternatively, the baffles plates 124 may be constructed as a separate assembly and attached to the riser 74. At least some and desirably all of the baffle plates are tilted at an angle A1 off vertical to deflect heat and flames from the flue 40 toward perimeter areas of the bottom surface of the catalyst 60, thus spreading the heat and flames more uniformly over the bottom surface (see FIG. 4). Portions of adjacent baffle plates 124 overlap one another to further limit direct flame contact with the bottom surface of the catalyst.

In the illustrated embodiment, four baffle plates 124 are provided, but this number may vary from one to any number more than one. The plates are evenly distributed on opposite sides of the central vertical axis 88 of the pathway, that is, two plates on each side as viewed in FIG. 4. The two plates 124 on the left side (FIG. 4) are tilted in one direction, and the two plates 124 on the right side are tilted in the opposite direction. Each baffle plate 124 is generally z-shaped in transverse section such that the plate has a middle region 130, an upper region 132 angling in one direction relative to the middle portion, and a lower region 134 angling in a generally opposite direction relative to the middle portion. The middle region 130 of the plate 124 is tilted at the aforesaid angle A1 off vertical in the range of 10-30, e.g., about 22 degrees. The upper region is at an angle A2 relative to the middle portion 130 in the range of 30-90 degrees, e.g., about 45 degrees, and the lower region is an angle A3 relative to the middle portion in the range of 0-90 degrees, e.g., about 45 degrees. The angled orientation of the baffle plate 124 functions to deflect flames and spread heat with more uniform distribution in a direction toward perimeter portions of the catalyst 60. The angled configuration of the upper and lower regions 132, 134 functions to strengthen the baffle plates to resist warping at high temperatures. Moreover, the regions 132, 134 also add mass and contact length to the baffle plates for greater containment of the flames (e.g., increased heat absorption to reduce flame propagation). The extent of deflection will vary depending on the size of the baffle plate, the tilt of the baffle plate (angle A1), and the cross-sectional configuration of the baffle plate.

As illustrated in FIG. 4, the left baffle plates 124 are spaced apart such that the upper region 132 of one plate at least slightly overlaps (i.e., is directly above) the lower region 134 of the other (adjacent) plate. As a result, flames in the flue 40 are prevented from moving vertically between the two left baffle plates into direct contact with the catalyst 60. Similarly, the right baffle plates 124 are spaced apart such that the upper region 132 of one plate at least slightly overlaps (i.e., is directly above) the lower region 134 of the other (adjacent) plate. As a result, flames in the flue 40 are prevented from moving vertically between the two right baffle plates into direct contact with the catalyst 60. Other baffle plate arrangements are possible.

The flame and heat spreader 70 of this invention reduces overheating of the catalyst 60 in several ways, thereby increasing catalyst life and performance. First, the spreader 70 spaces the catalyst farther from the flue 40. The distance of this spacing is controlled by the height H of the lower portion of the riser (see FIG. 3). This height H will vary depending on various factors, including the impedance to flow created by the baffle plates 124, the volume of air flow through the flue 40, and the temperatures in the cooking chamber 26. In general, however, the height H should be such that the lower volume is sufficient to balance the impedance added by the baffle plates 124, so that substantially all of the heated gas from the cooking chamber passes up through the catalyst 60 and is cleaned. In the illustrated embodiment, the height H of the riser is in the range of 1-12 in., e.g., about two inches. Second, the baffle plates 124 deflect at least some of the heat and flames from the flue 40 toward perimeter areas of the catalyst 60 to achieve a more uniform distribution of heat over the bottom surface 68 of the catalyst. Without such deflection, more heat and gas would be directed toward the central area of the catalyst directly above the lower flue stack 44, which could cause localized overheating of that area of the catalyst. Third, the baffle plates 124 prevent or at least inhibit flames in the flue 40 from moving vertically along the flow path 86 into direct contact with the catalyst 60. Instead, the flames impact first against the baffle plates 124, each of which covers a horizontal cross sectional area of the flow path 86 corresponding to the horizontal projection 146 of the baffle plate (see FIG. 4). The effect is to increase the flame path along the baffle plates which reduces direct flame contact/high temperature impingement with the catalyst bottom 68.

Baffle stiffeners 150 extend generally transversely with respect to the baffle plates 124 for stiffening the baffle plates against warping due to heat and flames in the flue 40. The stiffeners 150 comprise a number of stiffening plates 152 spaced at intervals along the baffle plates 124, two such stiffening plates 152 being shown in FIG. 2. The baffle plates 124 extend through slots 154 in the stiffening plates 152. The slots 154 have a size and shape closely matching the size and shape of the baffle plates so that the stiffening plates 152 assist in maintaining the proper spacing between the baffle plates 124. The number of stiffening plates 152 can vary, as needed. Other baffle stiffening arrangements are possible.

Figure 6:
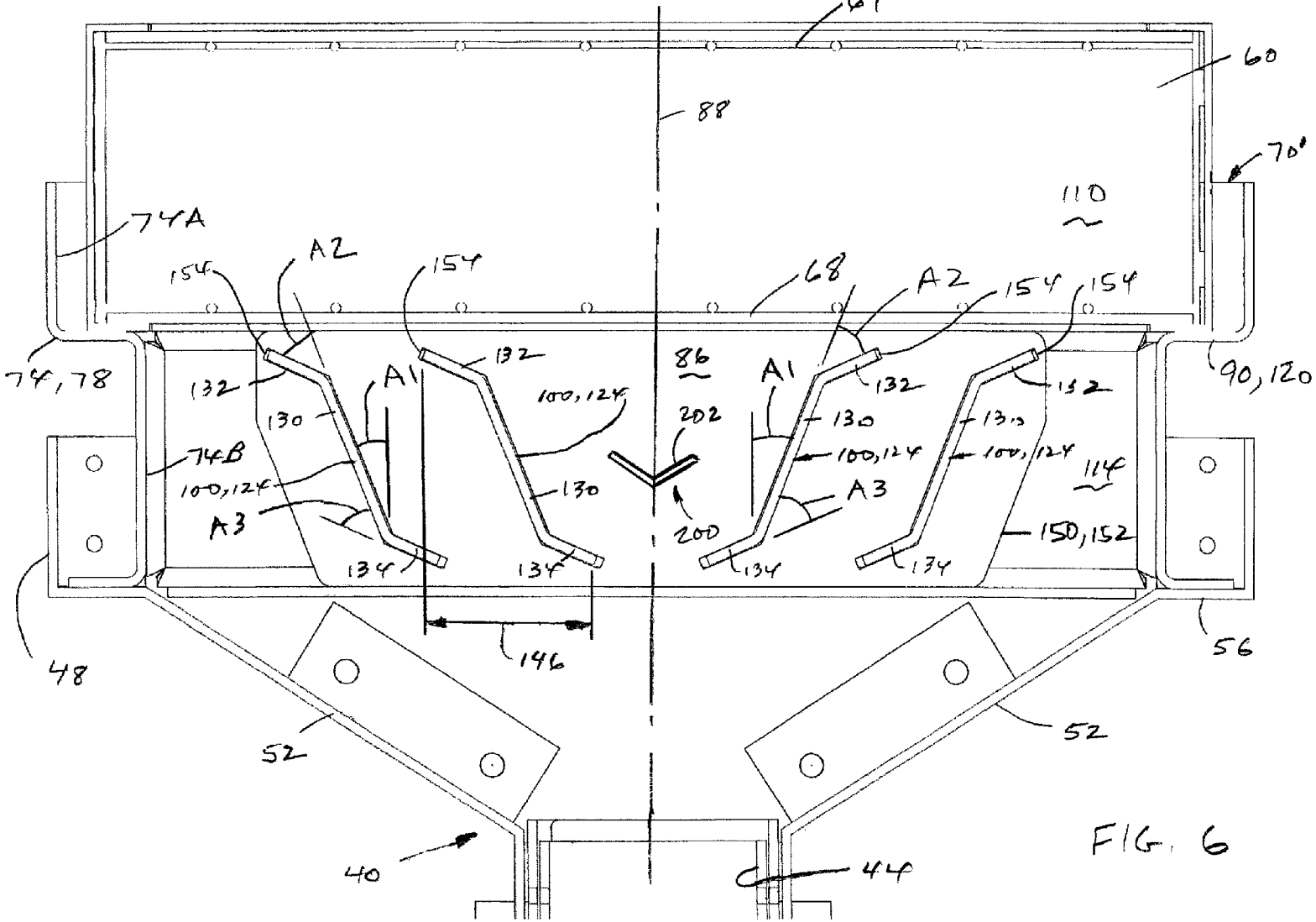
FIG. 6 is a view similar to FIG. 3 but showing an alternative baffle configuration.
Figure 7A:
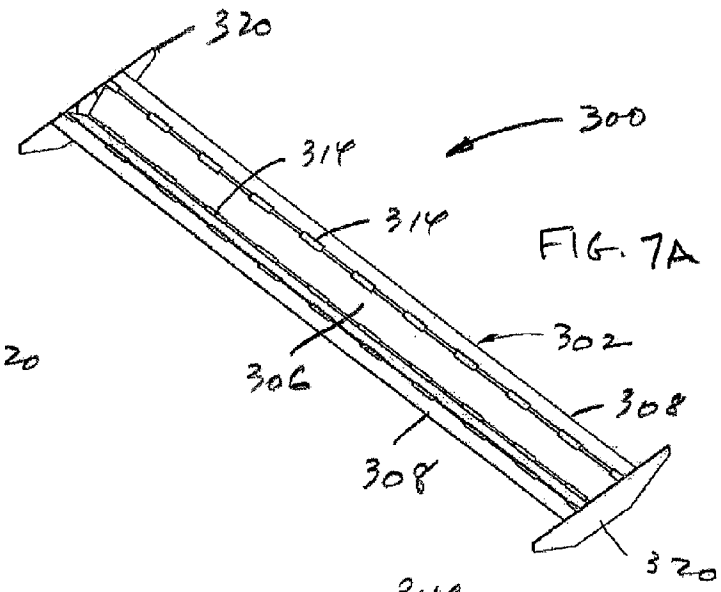
FIG. 7A is a perspective view of an alternative baffle design.
Figure 7D:
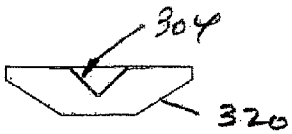
FIG. 7D is a vertical section taken in the plane of lines 7D-7D of FIG. 7C.
Figure 7B:
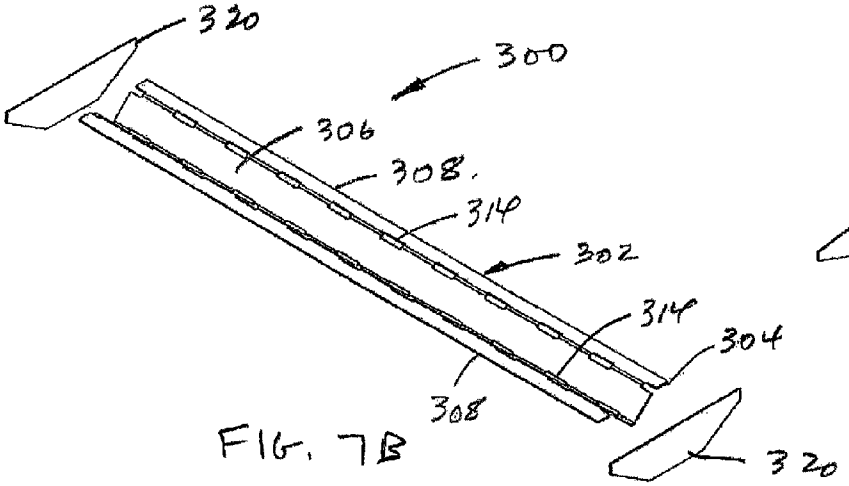
FIG. 7B is an exploded view showing various components of the baffle design of FIG. 7A.
Figure 7C:
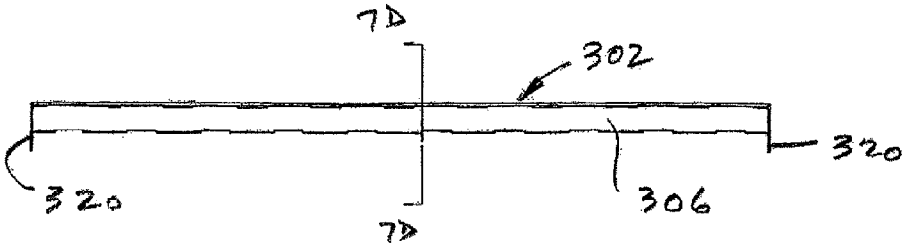
FIG. 7C is a side elevation of FIG. 7A.
Figure 9A:
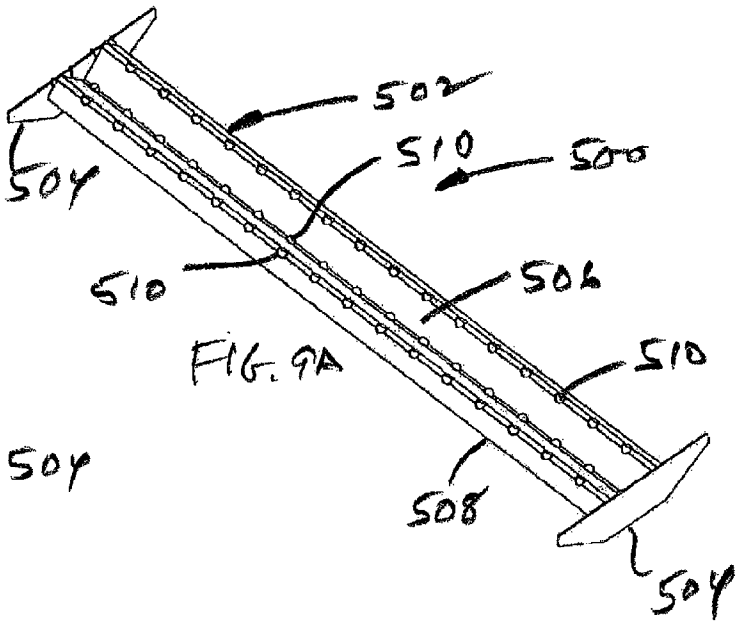
FIG. 9A is a perspective view of an alternative baffle design.
Figure 9B:
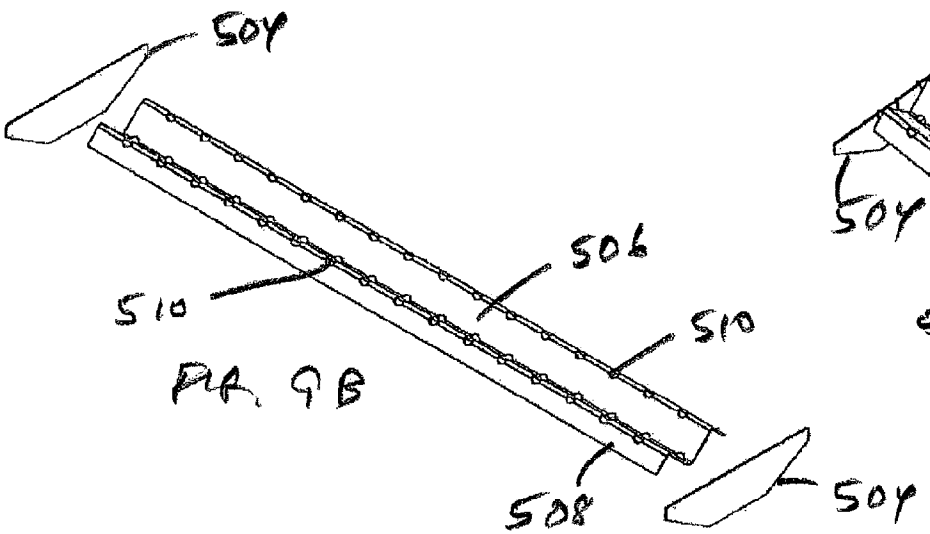
FIG. 9B is an exploded view showing various components of the baffle design of FIG. 9A.
Figure 9D:
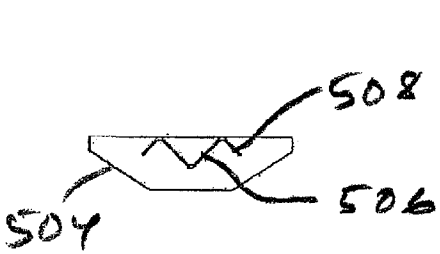
FIG. 9D is a vertical section taken in the plane of lines 9D-9D of FIG. 9C.
Figure 9C:
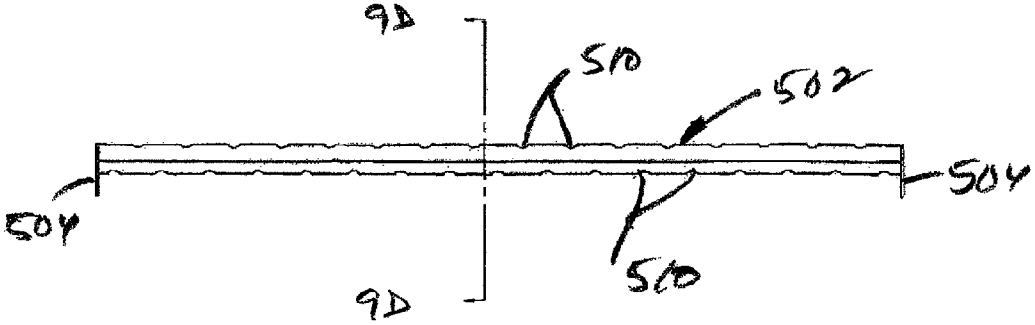
FIG. 9C is a side elevation of FIG. 9A.
Figure 10A:
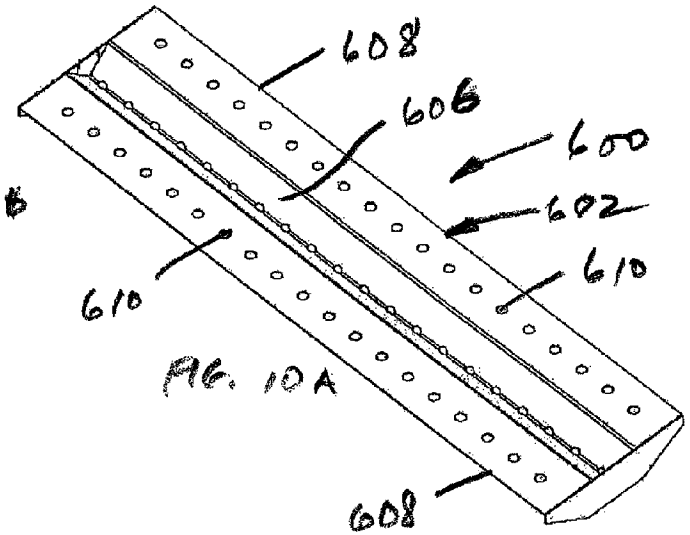
FIG. 10A is a perspective view of an alternative baffle design.
Figure 10A:
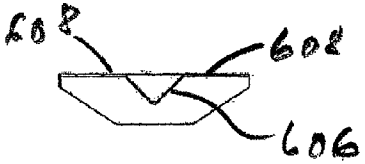
Figure 10B:
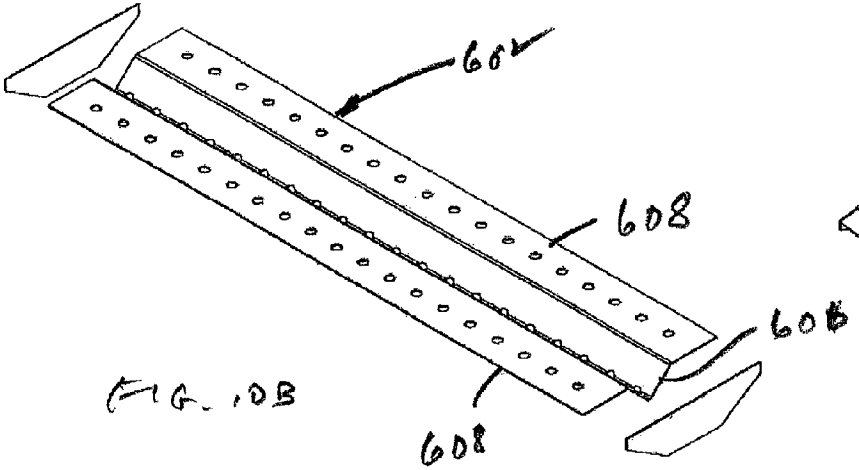
FIG. 10B is an exploded view showing various components of the baffle design of FIG. 10A.
Figure 10C:
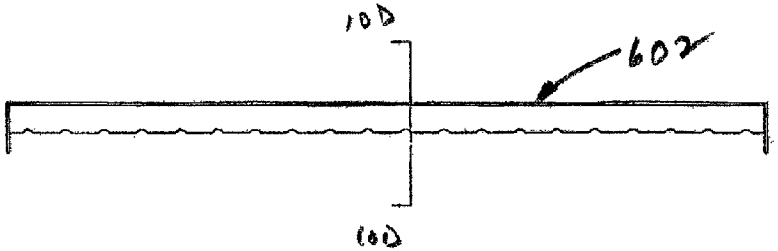
FIG. 10C is a side elevation of FIG. 10A.
Figure 11A:
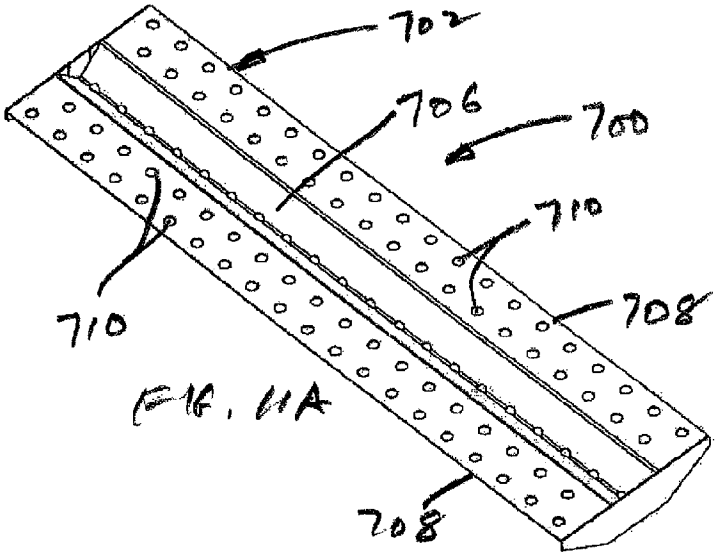
FIG. 11A is a perspective view of an alternative baffle design.
Figure 11D:
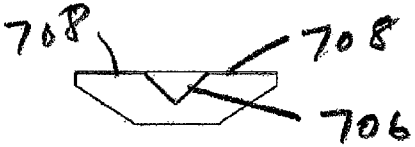
FIG. 11D is a vertical section taken in the plane of lines 11D-11D of FIG. 11C.
Figure 11B:
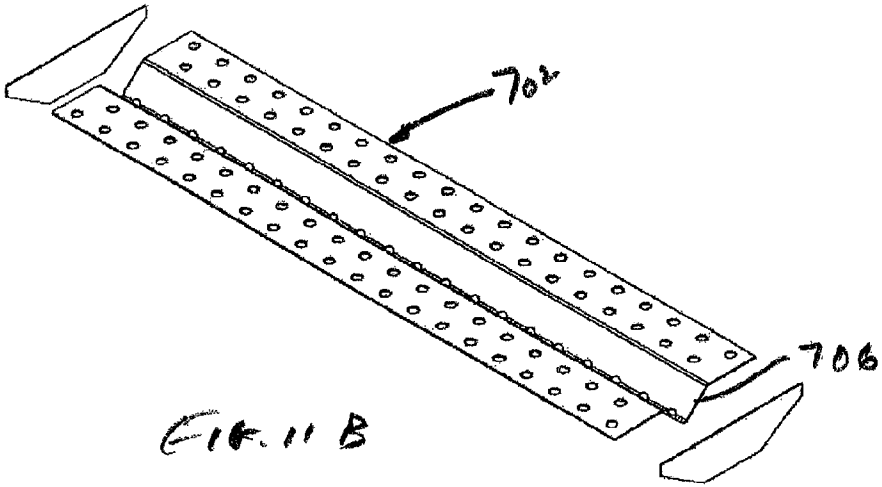
FIG. 11B is an exploded view showing various components of the baffle design of FIG. 11A.
Figure 11C:
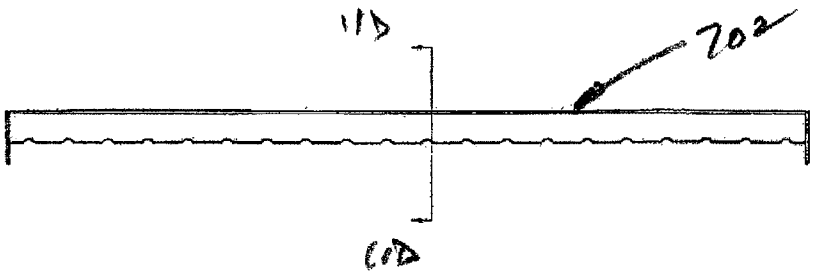
FIG. 11C is a side elevation of FIG. 11A.
Figure 12A:
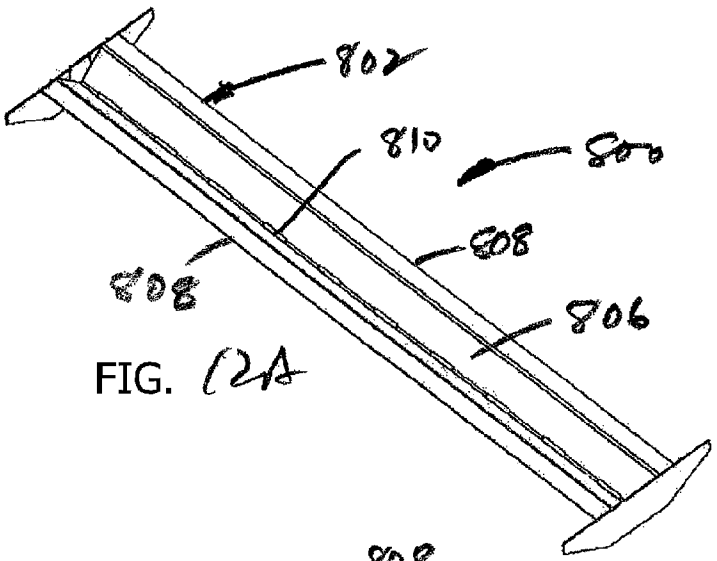
FIG. 12A is a perspective view of an alternative baffle design.
Figure 12D:
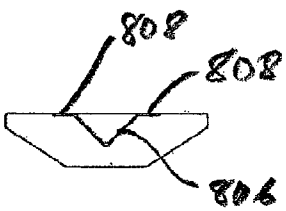
FIG. 12D is a vertical section taken in the plane of lines 12D-12D of FIG. 12C.
Figure 12B:
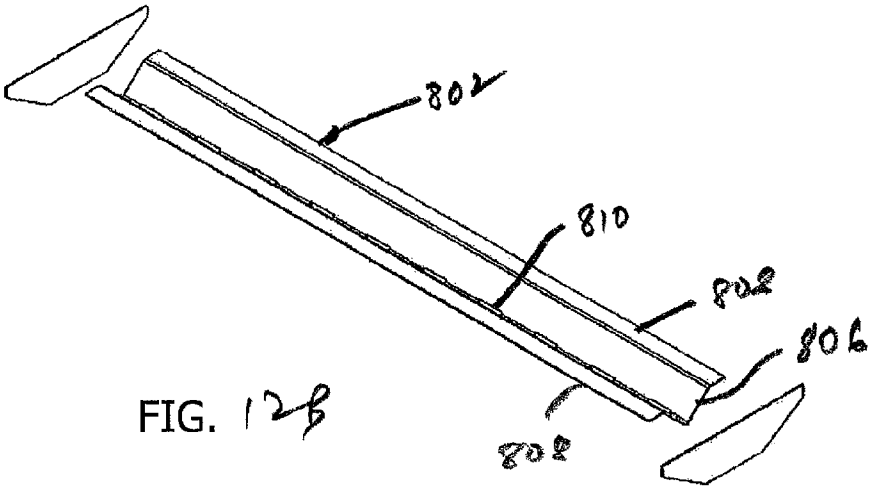
FIG. 12B is an exploded view showing various components of the baffle design of FIG. 12A.
Figure 12C:
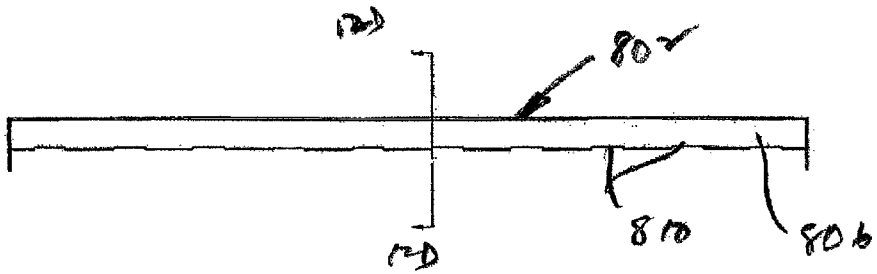
FIG. 12C is a side elevation of FIG. 12A.
Figure 13A:
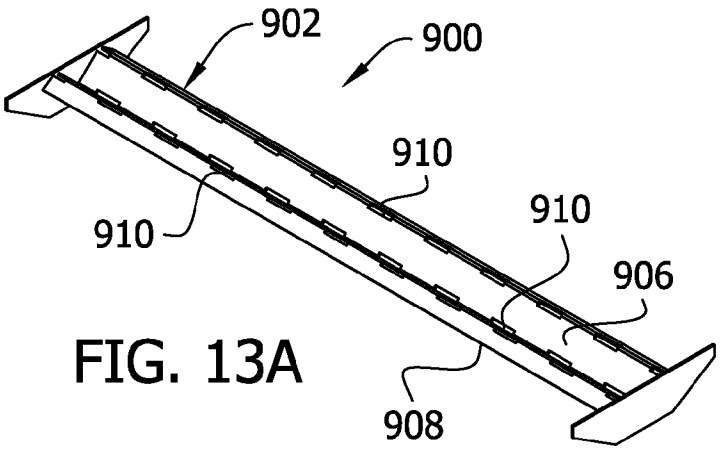
FIG. 13A is a perspective view of an alternative baffle design.
Figure 13B:
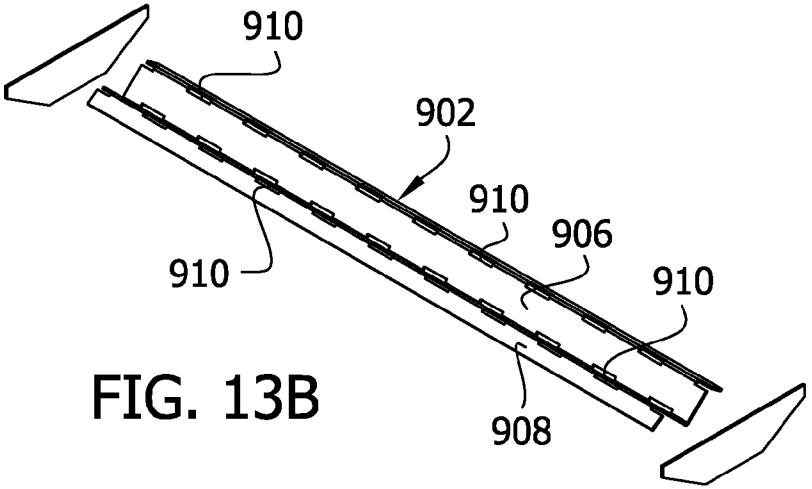
FIG. 13B is an exploded view showing various components of the baffle design of FIG. 13A.
Figure 13C:
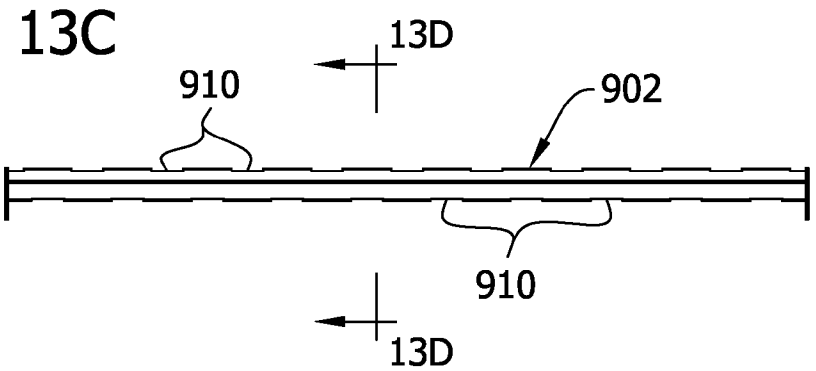
FIG. 13C is a side elevation of FIG. 13A.
Figure 13D:
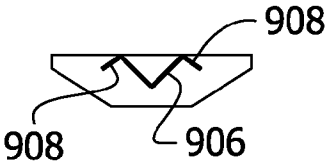
FIG. 13D is a vertical section taken in the plane of lines 13D-13D of FIG. 13C.
Figure 14A:
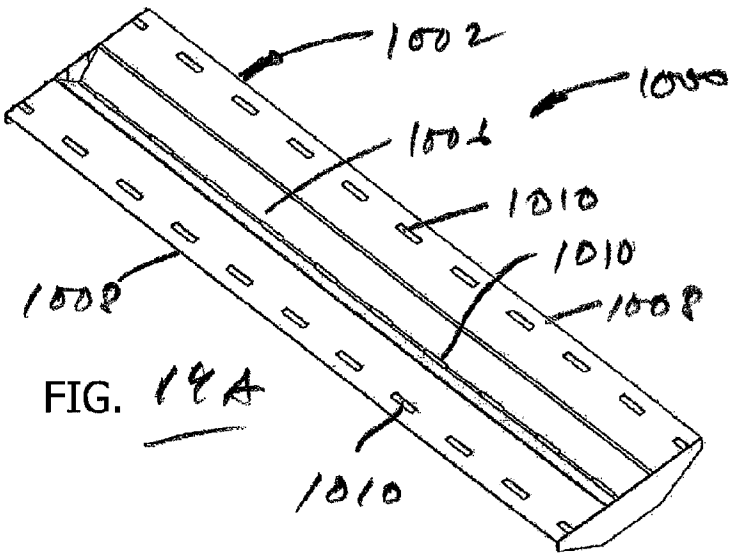
FIG. 14A is a perspective view of an alternative baffle design.
Figure 14D:
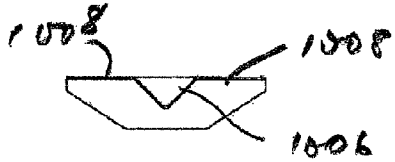
FIG. 14D is a vertical section taken in the plane of lines 14D-14D of FIG. 14C.
Figure 14B:
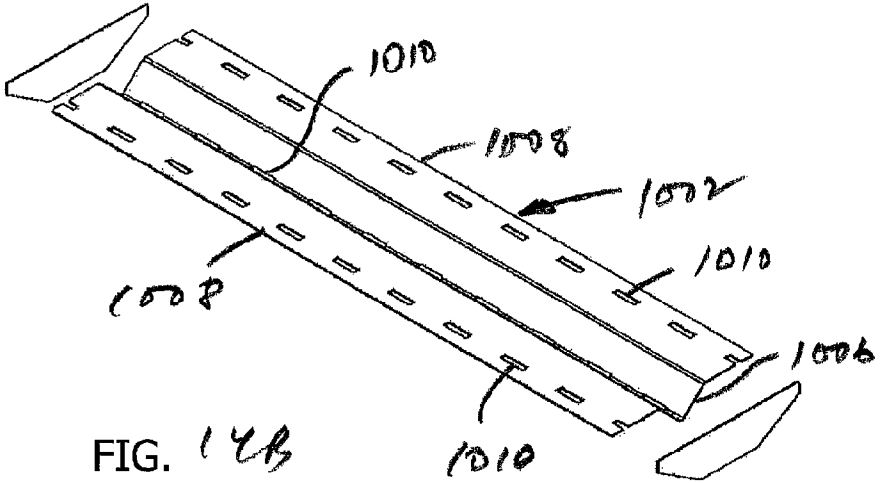
FIG. 14B is an exploded view showing various components of the baffle design of FIG. 14A.
Figure 14C:
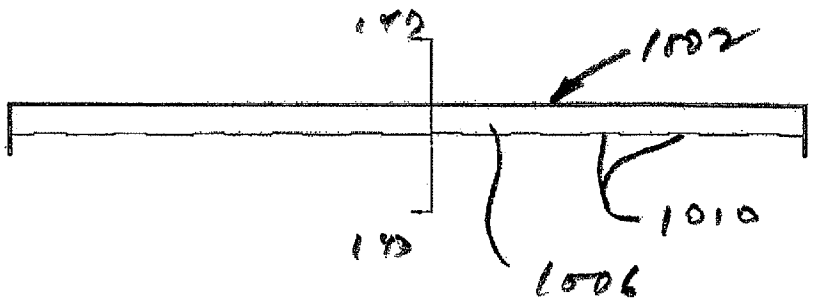
FIG. 14C is a side elevation of FIG. 14A.
Figure 15A:
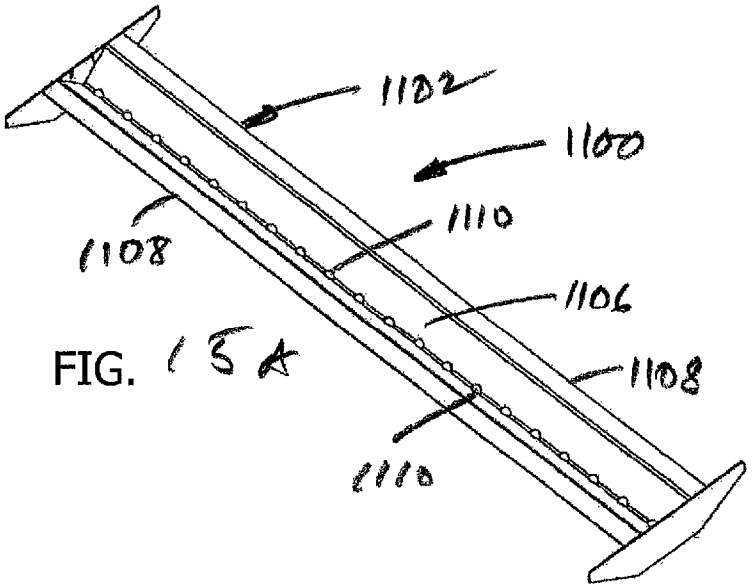
FIG. 15B is an exploded view showing various components of the baffle design of FIG. 15A.
FIG. 15C is a side elevation of FIG. 15A.
FIG. 15D is a vertical section taken in the plane of lines 15D-15D of FIG. 15C.
Figure 15D:
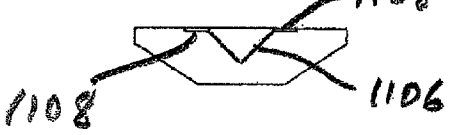
Figure 15B:
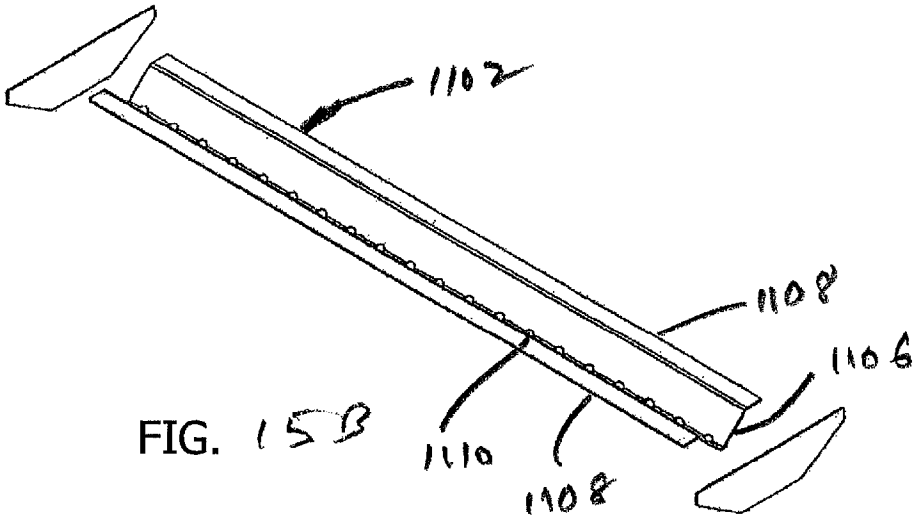
Figure 15C:
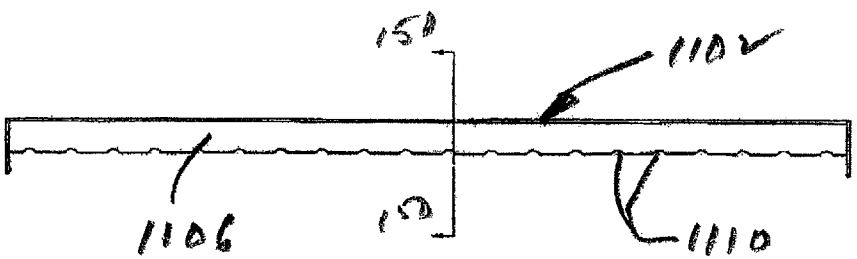
Figure 16A:
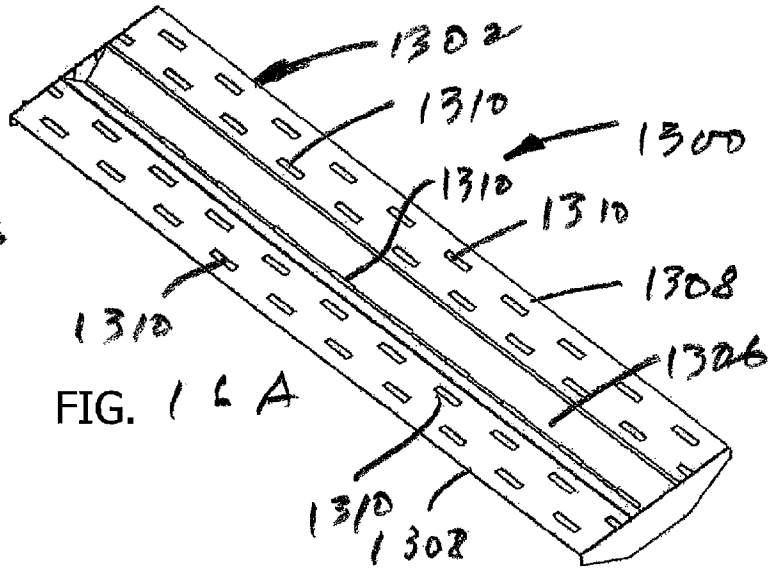
FIG. 16A is a perspective view of an alternative baffle design.
Figure 16D:
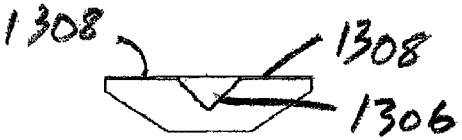
FIG. 16D is a vertical section taken in the plane of lines 16D-16D of FIG. 16C.
Figure 16B:
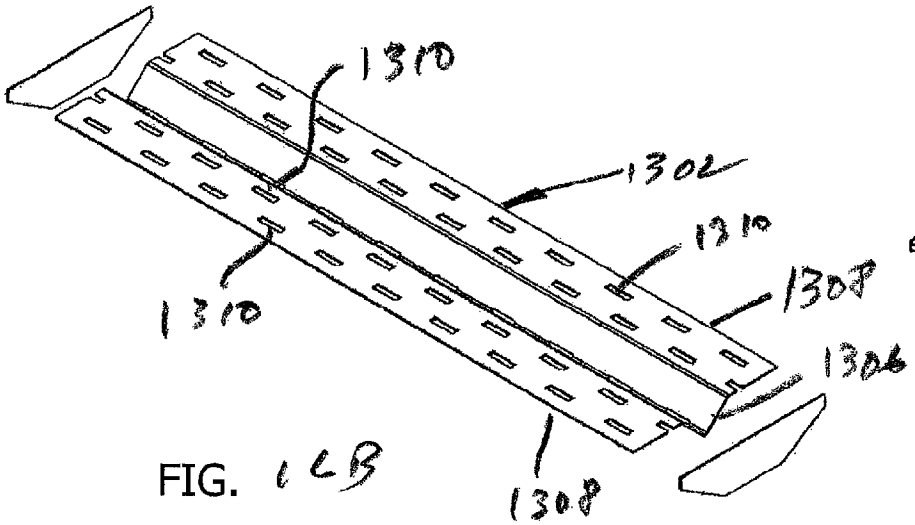
FIG. 16B is an exploded view showing various components of the baffle design of FIG. 16A.
Figure 16C:
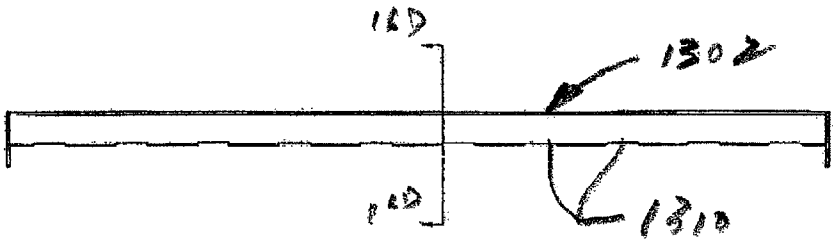
FIG. 16C is a side elevation of FIG. 16A.

FIG. 6 illustrates a second embodiment of the flame and heat spreader, generally designated 70'. The spreader 70' is of substantially the same construction as the spreader 70 of the previous embodiment, and the same numbers are used to identify corresponding parts. However, the spreader 70' also includes a center baffle 200 for deflecting flames and heated gases away from the central area of the catalyst 60. The center baffle 200 comprises a rigid, generally V-shaped baffle plate 202 extending generally parallel to the baffles 100 the full length of the lower portion 74B of the riser 74. In the illustrated embodiment, the V-shaped baffle plate 202 has an overall cross-sectional width such that it vertically overlaps adjacent baffles 100. As a result, substantially the entire bottom surface 68 of the catalyst 60 is shielded against direct contact by flames and high-temperature heat in the flue.

FIG. 7 shows an alternative baffle system, generally designated 300, which would replace the baffles 100 of the first embodiment and the baffles 100, 200 of the second embodiment. The baffle system 300 comprises a single baffle 302 in the form of an elongate baffle plate 304 having a V-shaped center region 306 and side regions 308 extending generally horizontally from the upper ends of the center region. Holes 314 are provided in the baffle plate 304 at spaced intervals along the baffle plate. The system 300 also includes mounting plates 320 for mounting the baffle plate 304 in a generally horizontal position above the lower flue stack 44 and running lengthwise of the flue stack. In one embodiment, the mounting plates 320 are attached (by welding, fasteners, or other means) to the floor 52 of the upper flue stack 48 adjacent opposite ends of the lower flue stack 44, and opposite ends of the baffle plate 304 are attached to respective mounting plates such that baffle plate 304 is substantially centered over the lower flue stack. Alternatively, the mounting plates 320 may simply rest on the floor 52 of the upper flue stack without attachment to the floor. In this regard, the angled sides of the mounting plates 320 cooperate with the floor 52 to properly locate the mounting plates and baffle plate 304 in side-to-side direction relative to the flue assembly. In this embodiment, the overall length of the baffle plate 304 is substantially the same as the overall length of the lower flue stack 44, and the overall side-to-side width of the baffle plate 304 is somewhat greater than the width of the lower flue stack. Heated gases emitted from the lower flue stack are in part deflected by the baffle plate 304 toward opposite sides of the upper flue stack 48, and in part pass through the holes 314. Flames impinging against the baffle plate 304 are, for the most part, also deflected, and any flames passing through the holes 314 are of reduced size so they cannot make direct contact with the bottom surface of the catalyst 60.

Alternatively, the baffle 302 can be mounted in the lower portion 74B of the riser 74 directly above the lower flue stack 44, like the baffle 200 in FIG. 6. However, as noted above, the baffle 302 is wider than baffle 200. In this embodiment, opposite ends of the baffle 302 can be suitably attached to opposite sides 82 of the riser 74.

FIGS. 8-16 illustrate variations of the baffle system 300. Other variations are possible.

In FIGS. 8A-8D, the baffle system 400 includes one or more baffles 402 and mounting plates 404 for mounting the baffles in a generally horizontal position above the lower flue stack 44 and running lengthwise of the flue stack. The baffle 402 has a central V-shaped portion 406 and generally horizontal wings 408 extending laterally out from the upper ends of the central portion. Holes 410 are provided along the bottom of central portion 406 and at the junctures of the wings 408 and the central portion.

In FIGS. 9A-9D, the baffle system 500 includes one or more baffles 502 and mounting plates 504 for mounting the baffles in a generally horizontal position above the lower flue stack 44 and running lengthwise of the flue stack. The baffle 502 has a central V-shaped portion 506 and wings 508 wings 508 extending laterally outward and downward from the upper ends of the central portion. Holes 510 are provided along the bottom of central portion 506 and at the junctures of the wings 508 and the central portion.

FIGS. 10A-10D show a baffle system 600 having the same configuration as the baffle system of 400 of FIGS. 8A-8D, except that holes 610 in the baffle 602 are provided along the center regions of the wings 608 instead of at the junctures of the wings 608 and the central portion 606 of the baffle.

FIGS. 11A-11D show a baffle system 700 having the same configuration as the baffle system 600 of FIGS. 10A-10D, except that two rows of holes 710 are provided in each baffle 702 along the center region of each wing 708 at a respective side of the central V-shaped portion 706.

FIGS. 12A-12D show a baffle system 800 having the same configuration as the baffle system 400 of FIGS. 8A-8D, except that the holes 810 in the baffle 802 along the bottom the V-shaped central portion 806 are elongate slots instead of round, and there are no holes at the junctures of the wings 808 and the central portion 806 of the baffle.

FIGS. 13A-13D show a baffle system 900 having the same configuration as the baffle system 500 of FIGS. 9A-9D, except that the holes 910 in the baffle 902 along the bottom of the V-shaped central portion 906 and at the junctures of the wings 908 and the central portion are elongate slots instead of round holes.

FIGS. 14A-14D show a baffle system 1000 having the same configuration as the baffle system 600 of FIGS. 10A-10D, except that holes 1010 in the baffle 1002 along the bottom of central V-shaped portion 1006 and along the wings 1008 are elongate slots instead of round holes.

FIGS. 15A-15D show a baffle system 1100 having the same configuration as the baffle system 800 of FIGS. 12A-12D, except that holes 1110 in the baffle 1102 along the bottom of the V-shaped central portion 1106 are round holes instead of elongate slots. There are no holes at the junctures of the wings 1108 and the central portion 1106 of the baffle.

FIGS. 16A-16D show a baffle system 1300 having the same configuration as the baffle system 700 of FIGS. 11A-11D, except that holes 1310 in the baffle 1302 along the bottom of the V-shaped central portion 1306 and along the wings 1308 are elongate slots instead of round holes.

FIGS. 17-23 show apparatus, generally designated 1200, for substantially blocking flames and spreading heated gases emitted from a broiler flue (e.g., flue 40 described above). The apparatus 1200 comprises a riser 1202 adapted to be placed above the broiler flue for defining a pathway along which heated gases are exhausted from the flue, a catalyst support 1206 on the riser for supporting a catalyst 1208 in the pathway for flow of heated gases through the catalyst from a bottom surface 1210 of the catalyst to a top surface 1212 of the catalyst, and a plurality of elongate baffles 1220 in the riser extending across the pathway below the catalyst support 1206 (see FIG. 21).

Figure 18:
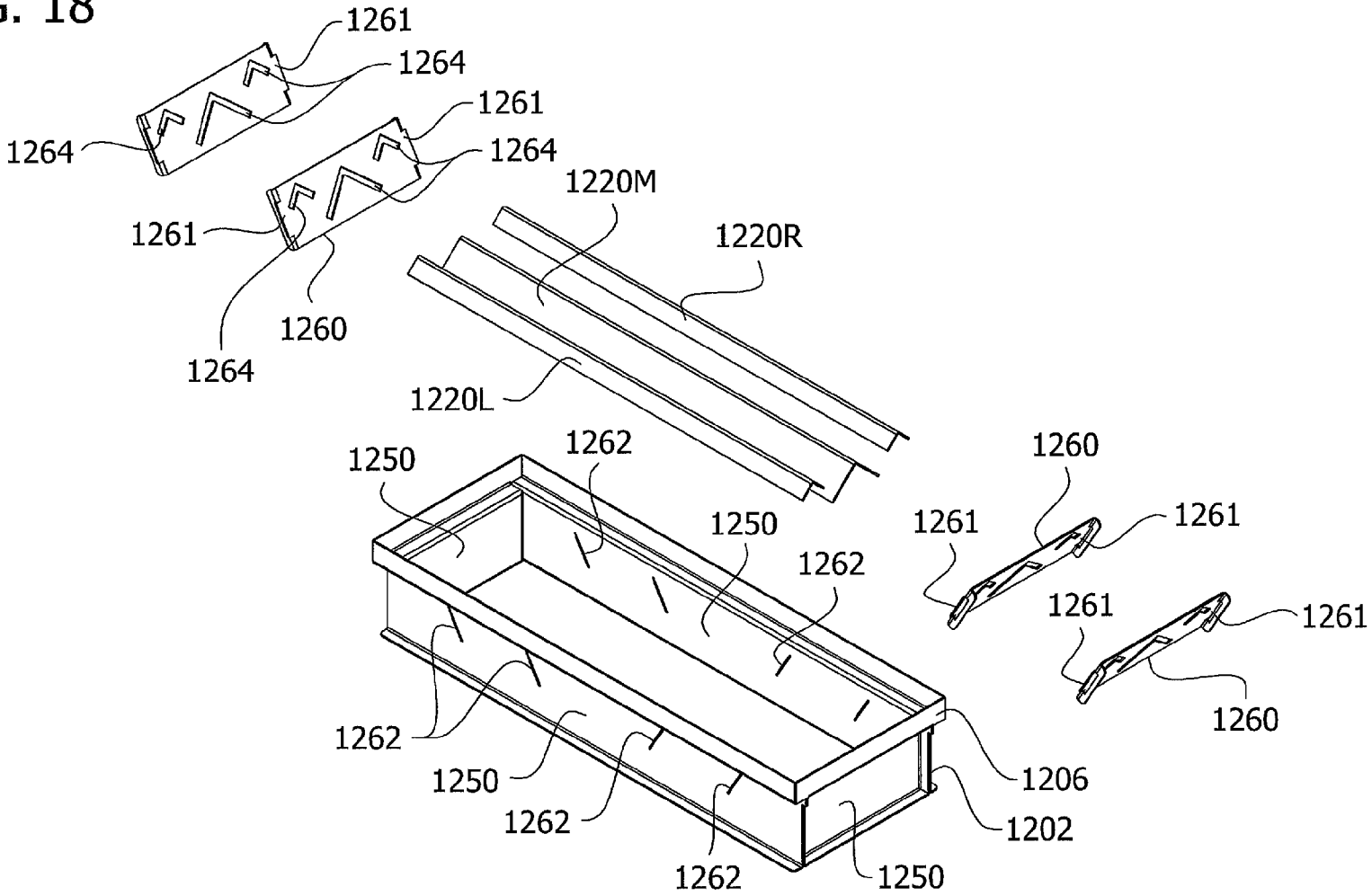
FIG. 18 is an exploded view showing various components of the apparatus of FIG. 17A.
Figure 19:
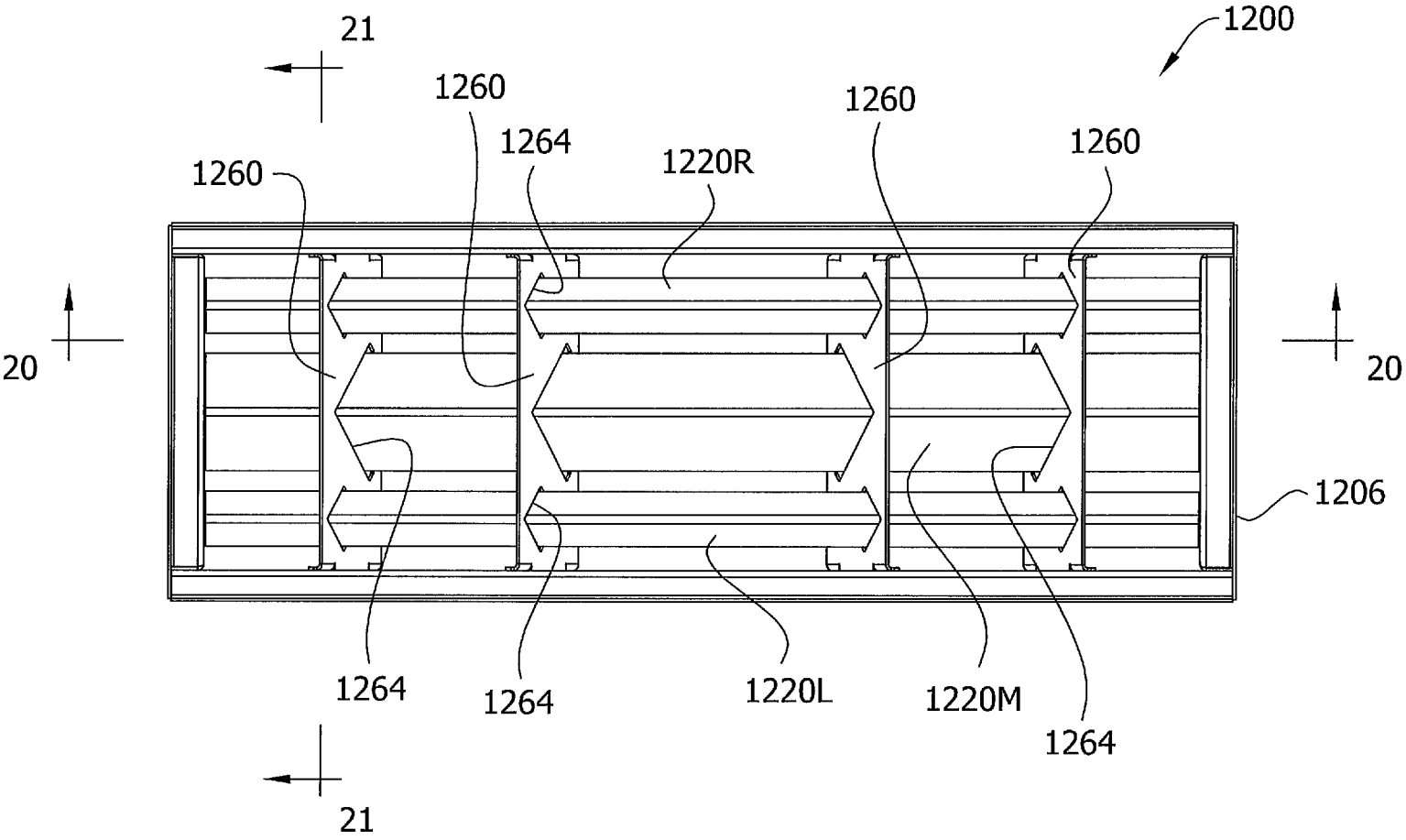
FIG. 19 is a top view of the apparatus of FIG. 18.
Figure 20:
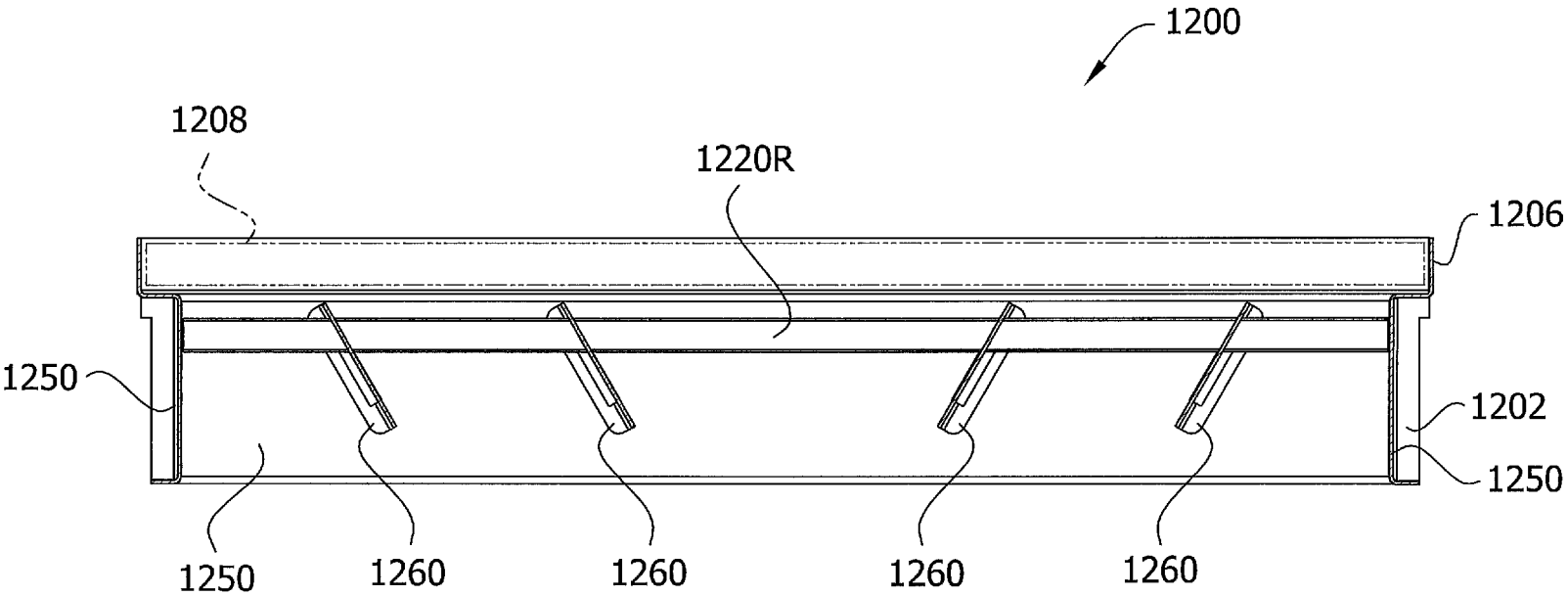
FIG. 20 is a vertical section taken in the plane of lines 20-20 of FIG. 19.
Figure 21:
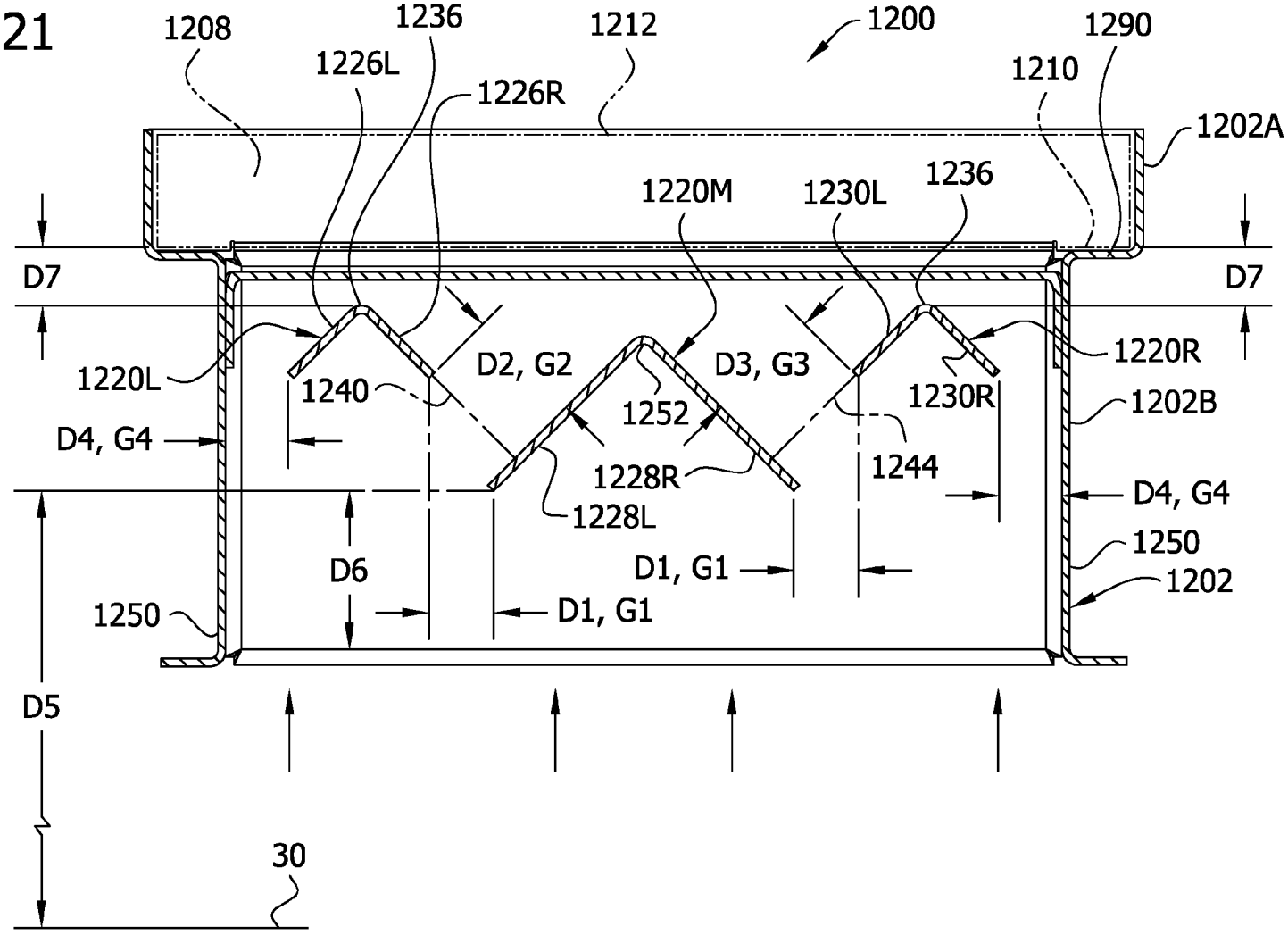
FIG. 21 is a vertical section taken in the plane of lines 21-21 of FIG. 19.

Referring to FIGS. 18 and 21, the baffles 1220 have the general shape of inverted troughs for substantially blocking flames emitted from the broiler flue and for spreading heated gases exhausted from the flue for more uniform distribution of the gases across the bottom surface 1210 of the catalyst 1208. In the illustrated embodiment, each baffle 1220 is an elongate member separate from the other baffle(s) and has the specific shape of an inverted-V, as viewed from an end of the baffle or in a cross section taken transverse to the length of the baffle. The included angle between the legs of the inverted "V" is about 90 degrees, but this angle may vary (e.g., from 20 to 170 degrees). In other embodiments, the apex of the inverted "V" may be rounded rather than sharp, or truncated, and any of these shapes may be provided with one or more lateral (horizontal or upward angled) wings. In still another embodiment, the baffles 1220 may include two immediately adjacent baffle elements each of inverted "V" shape that combine two give the baffles and overall generally "M" shape. Also, one or more of the baffles 1220 may have a shape that is concave, arcuate, or rounded (e.g., semicircular) in a cross section taken transverse to the length of the baffle. The term "inverted trough" is intended to cover all of the above configurations.

Also, instead of being separate elements, the baffles 1220 could be integrally formed as one piece with large openings for passage of gas, provided the connecting sheet metal between the baffle sections does not add an unacceptable amount of restriction/impedance to the hot flue gas flow. By way of example, a series of connecting webs of approximately ¼" width, spaced 4" apart, could connect the three inverted-V baffles 1220L, 1220M, 1220R illustrated in FIG. 21. Integrally formed baffles, for example, may have an M-shaped transverse cross section.

Referring to FIG. 21, the apparatus 1200 includes three separate baffles 1220, i.e., a first (left) baffle 1220L, a second (middle) baffle 1220M, and a third (right) baffle 1220R on a side of the second baffle opposite the first baffle. The first baffle 1220L has left and right downwardly diverging legs 1226L, 1226R; the second baffle 1220M has left and right downwardly diverging legs 1228L, 1228R; and the third baffle 1220R has left and right downwardly diverging legs 1230L, 12230R. The apex 1232 of the middle baffle 1220M is below the apexes 1236 of the left and right baffles 1220L, 1220R, which are at about the same elevation. The left and right baffles 1220L, 1220R are of substantially the same cross-sectional size and shape. The middle baffle 1220M is substantially centered between the left and right baffles 1220L, 1220R and has the same cross-sectional shape as the left and right baffles. For the particular configuration flue configuration illustrated in FIG. 21, the middle baffle is larger in both overall height and width than the left and right baffles. This is because there is a flame/heat concentration in the center ~⅓ of the area above the discharge of flue 40, and the larger middle baffle 1220M diverts and evens out the central heat concentration to the adjacent baffles 1220L and 1220R. Together, the three baffles function to spread the heat more uniformly upward and into the catalyst 1208. Other baffle arrangements are possible for other flue configurations.

Each baffle 1220 is spaced from an adjacent baffle by a horizontal distance D1 in the range of 0.25-1.0 in. to provide a horizontal gap G1 sufficiently small to substantially block flames emitted from the broiler flue 40 but sufficiently large to allow flow of heated gases to the catalyst on the catalyst support without an excessive pressure drop from the upstream (lower) side of the baffle to the downstream (upper) side of the baffle. In this regard, it is desirable that such pressure drop be no more than about 0.05 inch water column, and even more desirably no more in about 0.01 inch water column. In one embodiment, the distance or dimension D1 is desirably in the range of 0.25-2.2 in., more desirably in the range of 0.50-1.00 in., and even more desirably about 0.62 in.

The right leg 1226R of the first baffle 1220L is spaced from the left leg 1228L of the second adjacent baffle 1220M by a minimum angled distance D2 in the range of 0.75-2.2 in. taken along a line 1240 projected from the diverging right leg of the first baffle to the diverging left leg of second baffle (see FIG. 21). This angled distance D2 defines an angled gap G2 through which heated gases flow at an angle toward the catalyst 1208 for a more uniform distribution of the heated gases over the bottom surface 1210 of the catalyst. In one embodiment, the distance or dimension D2 is about 1.1" in.

Similarly, the right leg 1228R of the second baffle 1220M is spaced from the left leg 1230L of the third adjacent baffle 1220R by a minimum angled distance D3 in the range of 0.75-2.2 in. taken along a line 1244 projected from the diverging right leg of the second baffle to the diverging left leg of third baffle (see FIG. 21). This angled distance D3 defines an angled gap G3 through which heated gases flow at an angle toward the catalyst 1208 for a more uniform distribution of the heated gases over the bottom surface 1210 of the catalyst. In one embodiment, the distance or dimension D3 is desirably about 1.1" in.

Referring again to FIG. 21, the left leg 1226L of the first baffle 1220L and the right leg 1230R of the third baffle 1220R are spaced a minimum horizontal distance D4 in the range of 0.25-1.5 in. from a respective side wall 1250 of the riser 1202 to provide gaps G4 between the baffles 1220 and the side walls 1250. In one embodiment, the distance D4 is about 0.6 in.

Figure 22:
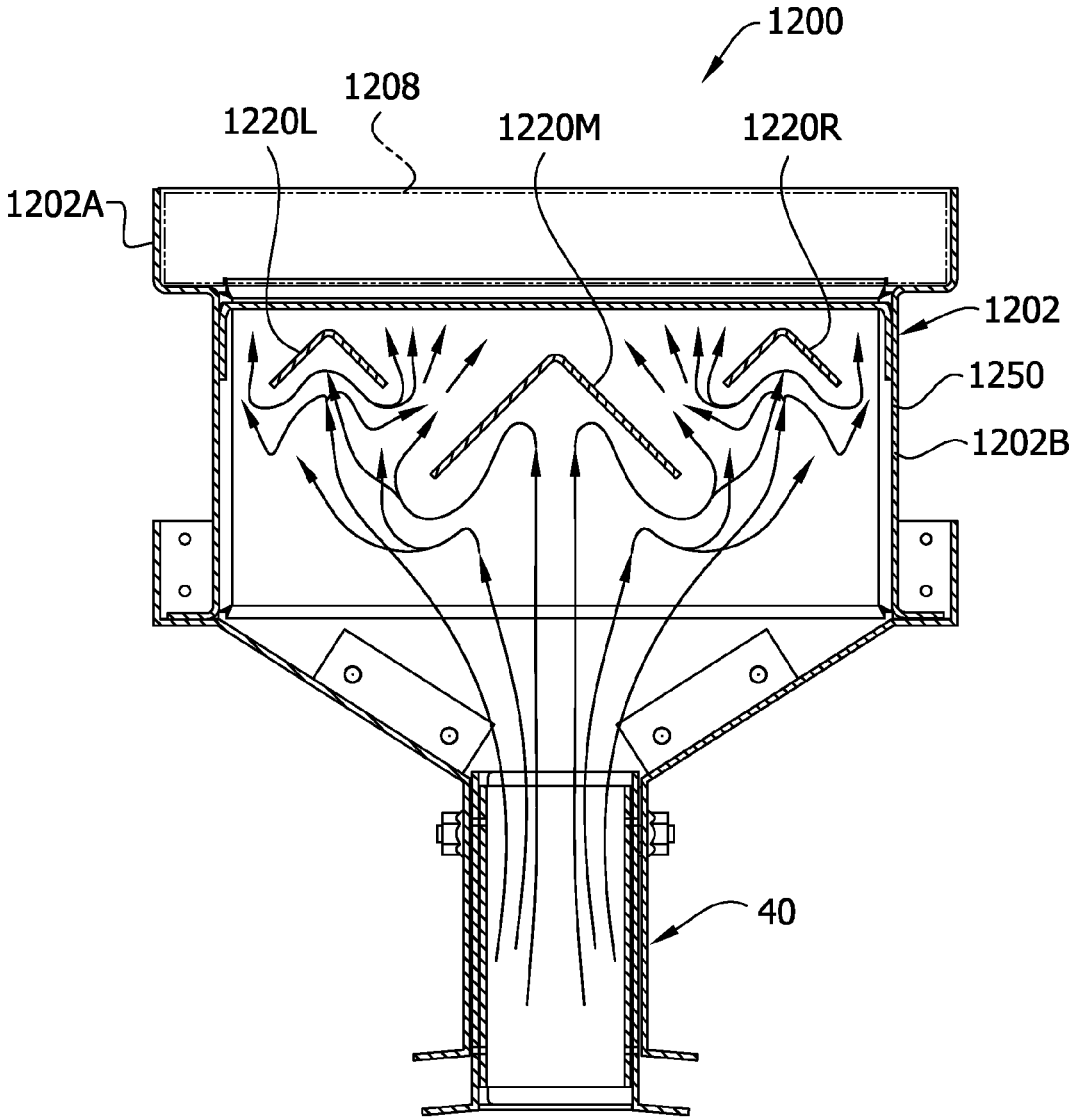
FIG. 22 is a vertical section similar to FIG. 21 but including a flue assembly and showing flow of heated gas.
Figure 23:
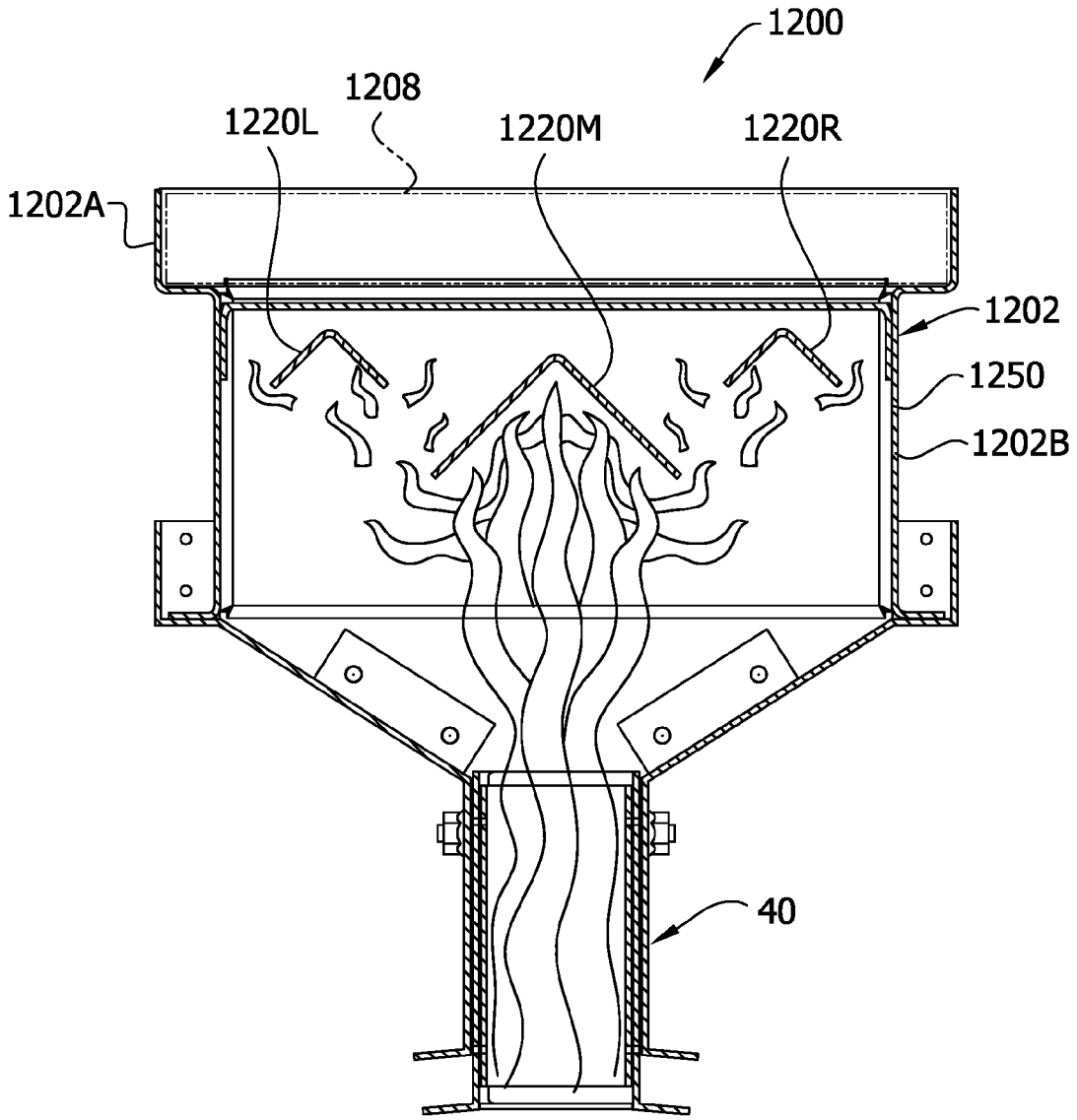
FIG. 23 is the vertical section of FIG. 22 but showing flames blocked by the apparatus.

FIGS. 22 and 23 show apparatus 1200 positioned above broiler flue 40 (described above). FIG. 22 includes arrows which indicate flow of heated gas exhausted from the flue 40 to the apparatus 1200. FIG. 23 illustrates flames emitted from the flue 40 and into apparatus 1200. As shown in FIG. 23, the baffle arrangement of the apparatus 1200 substantially blocks flames emitted from the flue 40 from reaching the catalyst 1208 without causing an excessive pressure drop in the riser 1202. As shown in FIG. 22, the baffles 1220 also deflect the flow of heated gases through gaps G1, G2, G3, and G4 (indicated in FIG. 21) to create a substantially uniform distribution of the heated gases over the bottom surface of the catalyst. As a result, the catalyst 1208 operates more efficiently and has a longer life.

The number of baffles 1220 used in a particular installation will vary depending in large part on the size of the flue. For small flues, two baffles may suffice. For larger flues, three or more baffles may be needed or desirable.

The baffles 1220 illustrated in FIGS. 17-23 are formed as non-perforated members of a suitable material (e.g., bent stainless steel plate having a thickness of in the range of 0.060-0.125 in, and desirably about 0.075 in.). However, the baffles may be perforated to provide a lower pressure drop and/or a more uniform distribution of heated gases over the bottom surface of the catalyst 1208, if needed or desired.

Figure 17:
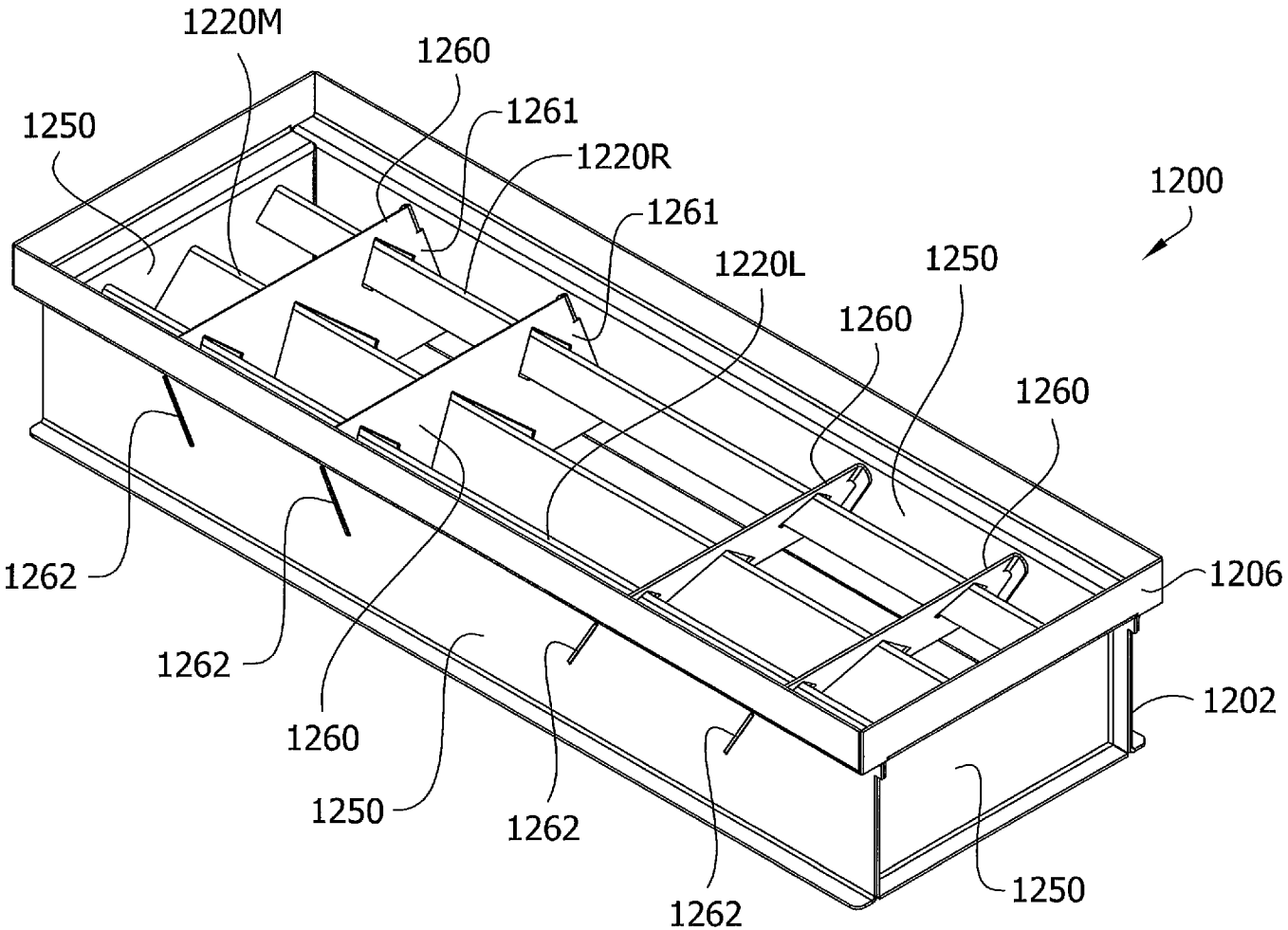
FIG. 17 is a top perspective of apparatus for substantially blocking flames and spreading heated gases from a broiler flue.

The baffles 1220 are mounted in the riser 1202 in the same manner as the baffles 100 of the first embodiment. Baffle stiffeners 1260 are provided. As shown in FIGS. 17 and 18, the stiffeners 1260 extend generally transversely with respect to the baffles 1220 for stiffening the baffles against warping due to heat and flames from the flue 40. The stiffeners 1260 comprise a number of stiffening plates (also designated 1260) spaced at intervals along the baffles, four such stiffening plates being shown in FIGS. 17 and 18. The stiffening plates 1260 are secured to opposing side walls 1250 of the riser 1202 by suitable means, such as tack welding. For reinforcement, the stiffening plates 1260 may have end tabs 1261 received in slots 1262 in respective side walls 1250 of the riser (see FIGS. 17 and 18). The baffles 1220 extend through slots 1264 in the stiffening plates 1260. The slots 1264 have sizes and shapes closely matching the sizes and shapes of the respective baffles so that the stiffening plates assist in maintaining the proper spacing between the baffles. The number of stiffening plates 1260 can vary, as needed. In the illustrated embodiment, two of the stiffening plates 1260 toward one end of the riser are slanted in one direction at a suitable angle 1264 (e.g., 60 degrees off horizontal), and two of the stiffening plates 1260 toward the opposite end of the riser are slanted in the opposite direction at about the same angle. Other baffle stiffening arrangements are possible.

The height of the riser 1202 will vary from one installation to another. In general, the height of the riser should be such that the baffles 1220 are located a distance D5 at least six in. above the cooking surface in the broiler, e.g., the upper reach of the conveyor 30 in FIGS. 3 and 21. Referring to FIG. 21, an exemplary distance or dimension D6 between the lowermost (middle) baffle 1220M and a lower end of the riser would be in the range of 0.25-6.0 in., even more desirably in the range of 1.0-3.0 in., and even more desirably about 1.6 in. Desirably, the distance or dimension D7 between the uppermost baffles 1220L, 1220R and the catalyst 1208 is in the range of 0.25-3.0 in, and even more desirably about 0.63 in.

The riser 1202 has an annular upper portion 1202A defining an upper volume for receiving the catalyst 1208 and an annular lower portion 1202B defining a lower volume containing the baffles 1220 (FIG. 21). The upper portion 1202A is wider than the lower portion 1202B. The catalyst 1208 rests on a catalyst support 1290 which, in this embodiment, comprises an annular member connecting the upper and lower annular portions 1202A, 1202B of the riser 1202. The catalyst 1208 may be supported in other ways above the baffles 1220. The annular lower portion 1202B has a height in the range of 1.0-8.0 in., and desirably about 4.0 in.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. Apparatus for substantially blocking flames and spreading heated gases from a broiler flue, said apparatus comprising a riser adapted to be placed above the broiler flue for defining a pathway along which heated gases are exhausted from the flue, a catalyst support on the riser for supporting a catalyst in the pathway for flow of heated gases through the catalyst, and a plurality of baffles in the riser extending across the pathway below the catalyst support, said baffles having the shape of inverted troughs for substantially blocking flames emitted from the broiler flue and for spreading heated gases exhausted from the flue for more uniform distribution of the heated gases across a bottom surface of the catalyst, the plurality of baffles comprising a first baffle, a second baffle, and a third baffle, wherein the second baffle is centered between the first and third baffles, wherein the second baffle is spaced from the first baffle and the third baffle by a horizontal distance D1 in the range of 0.25-1.0 in. to provide a horizontal gap sufficiently small to substantially block said flames but sufficiently large to allow flow of said heated gases to the catalyst without an excessive pressure drop; and wherein the second baffle is larger in cross-sectional height and width than the first and third baffles.

2. The apparatus of claim 1, wherein the first baffle has left and right downwardly diverging legs and the second baffle has left and right downwardly diverging legs, the right leg of a first baffle being spaced from the left leg of the second baffle by a minimum angled distance D2 in the range of 0.75-2.2 in. taken along a line projected from the diverging right leg of the first baffle to the diverging left leg of second baffle, said angled distance D2 defining an angled gap through which heated gases flow at an angle toward the catalyst for a more uniform distribution of the heated gases over the bottom surface of the catalyst.

3. The apparatus of claim 2, wherein the third baffle has left and right downwardly diverging legs, the right leg of the second baffle being spaced from the left leg of the third baffle by a minimum angled distance D3 in the range of 0.75-2.2 in. taken along a line projected from the diverging right leg of the second baffle to the diverging left leg of third baffle, said angled distance D3 defining an angled gap through which heated gases flow at an angle toward the catalyst for a more uniform distribution of the heated gases over the bottom surface of the catalyst.

4. The apparatus of claim 3, wherein D1 is in the range of 0.6-0.7 in., and D2 and D3 are in the range of 1.0-1.5 in.

5. The apparatus of claim 3, wherein each baffle of said plurality of baffles is generally of inverted-V shape.

6. The apparatus of claim 3, wherein the left and right legs of each baffle define an included angle in the range of 20-170 degrees.

7. The apparatus of claim 3, wherein the first, second, and third baffles are elongate members separate from the other baffles.

8. The apparatus of claim 7, wherein the second baffle has an apex below an apex of the first baffle and below an apex of the third baffle.

9. The apparatus of claim 3, wherein the first, second, and third baffles are spaced a minimum distance D4 of at least 0.25-6.0 in. above a lower end of the riser.

10. The apparatus of claim 3, wherein D4 is in the range of 1.5-4.0 in.

11. The apparatus of claim 3, wherein the first baffle is spaced a minimum distance D5 in the range of 0.25-1.5 in. from a side wall of the riser.

12. The apparatus of claim 1, further comprising baffle stiffeners extending generally transversely with respect to the baffle plates for stiffening the baffle plates against warping doe to said heat and flames.

13. The apparatus of claim 1, wherein the riser has an annular upper portion defining an upper volume for receiving the catalyst and an annular lower portion defining a lower volume containing said baffles, said annular lower portion having a height in the range of 1.0-8.0 in.

14. The apparatus of claim 13, wherein the upper volume is wider than the lower volume.

15. The apparatus of claim 13, in combination with a catalyst in said upper volume.

16. Apparatus for substantially blocking flames and spreading heated gases from a broiler flue, said apparatus comprising a riser adapted to be placed above the broiler flue for defining a pathway along which heated gases are exhausted from the flue, a catalyst support on the riser for supporting a catalyst in the pathway for flow of heated gases through the catalyst, and a plurality of baffles in the riser extending across the pathway below the catalyst support, said baffles having the shape of inverted troughs for substantially blocking flames emitted from the broiler flue and for spreading heated gases exhausted from the flue for more uniform distribution of the gases across a bottom surface of the catalyst, and wherein said plurality of baffles comprises a first baffle having left and right downwardly diverging legs, a second baffle adjacent the first baffle having left and right downwardly diverging legs, and a third baffle adjacent the second baffle having left and right downwardly divergent legs, the right leg of the first baffle being spaced from the left leg of the second baffle by a minimum angled distance in the range of 0.75-2.2 in. taken along a line projected from the diverging right leg of the first baffle to the diverging left leg of second baffle, the right leg of the second baffle being spaced from the left leg of the third adjacent baffle by a minimum angled distance in the range of 0.75-2.2 in. taken along a line projected from the diverging right leg of the second baffle to the left leg of third baffle, said angled distance defining an angled gap through which heated gases flow at an angle toward the catalyst for a more uniform distribution of the heated gases over the bottom of the catalyst;

wherein the second baffle is centered between the first and third baffles and the second baffle is larger in cross-sectional height and width than the first and third baffles.

17. Apparatus for substantially blocking flames and spreading heated gases from a broiler flue, said apparatus comprising a riser adapted to be placed above the broiler flue for defining a pathway along which heated gases are exhausted from the flue, a catalyst support on the riser for supporting a catalyst in the pathway for flow of heated gases through the catalyst, and first, second, and third baffles in the riser extending across the pathway below the catalyst support, the baffles having the shape of inverted troughs for substantially blocking flames emitted from the broiler flue and for spreading heated gases exhausted from the flue for more uniform distribution of the gases across a bottom surface of the catalyst, each baffle being spaced from an adjacent baffle by a horizontal distance D1 in the range of 0.25-1.0 in. to provide a horizontal gap sufficiently small to substantially block said flames but sufficiently large to allow flow of said heated gases to the catalyst without an excessive pressure drop, each baffle having left and right downwardly diverging legs, the right leg of the first baffle being spaced from the left leg of the second baffle by a minimum angled distance D2 in the range of 0.75-2.2 in. taken along a line projected from the diverging right leg of the first baffle to the diverging left leg of second baffle, and the right leg of the second baffle being spaced from the left leg of the third baffle by a minimum angled distance D3 in the range of 0.75-2.2 in. taken along a line projected from the diverging right leg of the second baffle to the diverging left leg of third baffle, said angled distances D2 and D3 defining angled gaps through which heated gases flow at an angle toward the catalyst for a more uniform distribution of the heated gases over the bottom of the catalyst, and wherein the second baffle is centered between the first and third baffles and the second baffle is larger in cross-sectional height and width than the first and third baffles.

18. Apparatus for substantially blocking flames and spreading heated gases from a broiler flue, said apparatus comprising a riser adapted to be placed above the broiler flue for defining a pathway along which heated gases are exhausted from the flue, a catalyst support on the riser for supporting a catalyst in the pathway for flow of heated gases through the catalyst, and a plurality of baffles comprising a first, second, and third baffle in the riser extending across the pathway below the catalyst support, said baffles having the shape of inverted troughs for substantially blocking flames emitted from the broiler flue and for spreading heated gases exhausted from the flue for more uniform distribution of the heated gases across a bottom surface of the catalyst, and each baffle being spaced from an adjacent baffle by a horizontal distance D1 in the range of 0.25-1.0 in. to provide a horizontal gap sufficiently small to substantially block said flames but sufficiently large to allow flow of said heated gases to the catalyst without an excessive pressure drop from the lower side of the baffle to the upper side of the baffle wherein the second baffle is centered between the first and third baffles and the second baffle is larger in cross-sectional height and width than the first and third baffles.

* * * * *